US009765487B2

(12) United States Patent
Harrison, Jr. et al.

(10) Patent No.: US 9,765,487 B2
(45) Date of Patent: Sep. 19, 2017

(54) SYSTEMS FOR APPLYING ROADWAY SURFACE TREATMENTS, AND METHODS OF USING SAME

(71) Applicant: BALDWIN PAVING CO., INC., Marietta, GA (US)

(72) Inventors: John Birch Harrison, Jr., Atlanta, GA (US); Carl Dean Osborn, Adairsville, GA (US); Jefferson C. Simmons, Jr., Dallas, GA (US); Garry Jansen, Clarkesville, GA (US)

(73) Assignee: BALDWIN PAVING CO., INC., Marietta, GA (US)

( * ) Notice: Subject to any disclaimer, the term of this patent is extended or adjusted under 35 U.S.C. 154(b) by 0 days.

(21) Appl. No.: 15/259,926

(22) Filed: Sep. 8, 2016

(65) Prior Publication Data

US 2017/0067214 A1 Mar. 9, 2017

Related U.S. Application Data

(60) Provisional application No. 62/215,512, filed on Sep. 8, 2015, provisional application No. 62/308,038, filed on Mar. 14, 2016, provisional application No. 62/322,032, filed on Apr. 13, 2016.

(51) Int. Cl.

| | |
|---|---|
| ***E01C 19/10*** | (2006.01) |
| ***E01C 19/17*** | (2006.01) |
| ***E01C 19/21*** | (2006.01) |
| ***B05B 13/00*** | (2006.01) |
| ***B05B 7/24*** | (2006.01) |
| ***B05B 12/14*** | (2006.01) |

(52) U.S. Cl.
CPC ..... *E01C 19/21* (2013.01); *B05B 7/2486* (2013.01); *B05B 7/2497* (2013.01); *B05B 12/1418* (2013.01); *B05B 13/005* (2013.01)

(58) Field of Classification Search
CPC ..... E01C 19/02; E01C 19/10; E01C 19/1009; E01C 19/1013; E01C 19/12; E01C 19/15; E01C 19/17; E01C 19/20; E01C 19/21
USPC ..... 404/108–111
See application file for complete search history.

(56) References Cited

U.S. PATENT DOCUMENTS 2,197,878 A * 4/1940 Robinson ..... E01C 19/21 118/118
3,128,997 A * 4/1964 Young ..... B01F 7/08 106/283
3,206,174 A * 9/1965 Young ..... B01F 7/086 106/277
3,771,893 A * 11/1973 Miller ..... B01F 13/0035 222/414
5,069,578 A * 12/1991 Bense ..... E01C 11/005 404/75

(Continued)

*Primary Examiner* — Gary Hartmann
(74) *Attorney, Agent, or Firm* — Ballard Spahr LLP

(57) ABSTRACT

Systems and methods for applying roadway surface treatments. The system has an aggregate application assembly and a resin application assembly that are mounted or otherwise secured to a truck or other vehicle. The resin application assembly is spaced from the aggregate application assembly in the direction of travel of the vehicle. As the vehicle moves along a roadway surface, the resin and aggregate can be continuously applied such that the aggregate is provided to portions of the roadway surface that have been covered with resin.

20 Claims, 27 Drawing Sheets

(56) References Cited

U.S. PATENT DOCUMENTS

| | | | | |
|---|---|---|---|---|
| 5,269,626 | A * | 12/1993 | Soliman | E01C 19/48 404/108 |
| 5,895,173 | A * | 4/1999 | O'Brien | E01C 19/21 404/108 |
| 6,776,557 | B2 * | 8/2004 | Barnat | E01C 19/21 404/101 |
| 6,802,464 | B2 * | 10/2004 | Marconnet | E01C 19/21 239/159 |
| 6,805,516 | B2 * | 10/2004 | Barnat | E01C 19/21 404/101 |
| 6,899,490 | B2 * | 5/2005 | Lee | E01C 19/405 404/101 |
| 6,918,714 | B2 * | 7/2005 | Chambard | E01C 19/176 404/111 |
| 8,545,128 | B2 * | 10/2013 | Weiler | E01C 19/1054 404/110 |
| 9,109,332 | B1 | 8/2015 | Stone, Jr. | |
| 9,115,473 | B1 | 8/2015 | Stone, Jr. | |
| 2016/0362628 | A1 | 12/2016 | Qin et al. | |

* cited by examiner

SYSTEMS FOR APPLYING ROADWAY SURFACE TREATMENTS, AND METHODS OF USING SAME

CROSS-REFERENCE TO RELATED APPLICATIONS

This application claims priority to U.S. Provisional Patent Application No. 62/215,512, filed on Sep. 8, 2015, U.S. Provisional Patent Application No. 62/308,038, filed on Mar. 14, 2016, and U.S. Provisional Patent Application No. 62/322,032, filed on Apr. 13, 2016, which applications are hereby incorporated by reference herein in their entireties.

FIELD

Disclosed herein are surface treatment systems and methods of applying surface treatments. More specifically, disclosed herein are roadway surface treatment systems that include a resin spraying apparatus and an aggregate distribution assembly to facilitate coverage of a road surface.

BACKGROUND

In the roadway construction industry, various surface treatments are conventionally applied to impart desired characteristics to a roadway. For example, surface treatments (e.g., coatings) can be applied to roadway surfaces to increase the coefficient of friction of the roadway, thereby reducing the possibility of slippage or skidding on the roadway. Conventionally, such high-friction surface treatments include polymer resin (e.g., epoxy resin) and aggregate materials that are separately applied in a stepwise process. Frequently, when using conventional methods of surface treatment application, the surface treatments are not mixed thoroughly, and there is no mechanism for real-time variation in the width of material distributed to a roadway surface. Additionally, conventional systems for applying roadway surface treatments have a lengthy and inefficient startup and shutdown process. Further, creep drives and other systems for adjusting the speed at which the application equipment moves along the roadway offer insufficient control to produce consistent surface treatments. Still further, conventional systems are incapable of continuously loading material to be dispensed on the roadway surface; this deficiency often leads to undesirable transverse joints in the roadway.

Therefore, there is a need within the art for systems and methods for addressing one or more of the above-described limitations.

SUMMARY

Described herein, in various aspects, is a system for applying a roadway surface treatment, such as, for example and without limitation, a high-friction surface treatment or a bridge deck overlay. The system can be configured for coupling to a vehicle moving over a roadway surface in a selected travel direction. It is further contemplated that the system can include such a vehicle. The system can include at least one container configured to receive at least one resin or epoxy component. The system can further include a spraying assembly positioned in fluid communication with the at least one container and configured to controllably dispense onto a roadway surface the at least one resin or epoxy component received from each container. The system can further include a hopper configured to receive and selectively dispense an aggregate material. The system can still further include a conveyor belt assembly configured to selectively deliver the aggregate material to the hopper. The hopper can have a gate that is selectively moveable from a closed position to an open position to dispense the aggregate onto the roadway surface at an aggregate delivery location. The spraying assembly and the hopper can be configured to continuously dispense the at least one resin or epoxy component and the aggregate material. The spraying assembly can be spaced from the aggregate delivery location in the selected travel direction such that the hopper dispenses the aggregate material onto portions of the roadway surface that have been coated with the at least one resin or epoxy component dispensed by the spraying assembly. Methods of using the disclosed systems are also described.

In one aspect, the system can comprise first and second containers and first and second proportioner assemblies positioned in communication with a respective one of the containers. Each of the first and second containers can be configured to receive a respective resin or epoxy component. A first pump can be positioned in between and in communication with the first container and the first proportioner assembly, and a second pump can be positioned in between and in communication with the second container and the second proportioner assembly. The first and second pumps can be configured to effect movement of first and second resin components from the first and second containers to the first and second proportioner assemblies at respective desired rates. Optionally, each pump can comprise an electric motor.

Each proportioner assembly can comprise a respective outlet that is positioned in fluid communication with a spraying assembly. In exemplary aspects, each proportioner assembly can be fluidly coupled to the spraying assembly by a respective conduit. In further exemplary aspects, the spraying assembly can comprise a plurality of spraying elements (e.g., spray guns or spray nozzles) that are configured to dispense a mixture of first and second resin or epoxy components at a desired rate and pressure onto a roadway surface. The spraying elements (e.g., spray guns or spray nozzles) can be coupled to an air compressor that provides compressed air to the spraying elements to permit control of the dispensing of the mixed resin or epoxy components.

The system can comprise first and second hoppers that are configured to receive an aggregate material. In one aspect, a conveyor belt assembly can extend between the first and second hoppers to selectively transport aggregate from the first hopper to the second hopper. Optionally, the second hopper can be positioned on a vehicle (e.g., truck), while the first hopper can be selectively removable from the vehicle. In another aspect, a conveyor assembly can be positioned between and in communication with the first hopper and the second hopper. In use, the conveyor assembly can transport aggregate from the first hopper to the second hopper. The second hopper can comprise a rear gate that opens to permit dispensing of the aggregate within the second hopper to a road surface.

In exemplary aspects, it is contemplated that the system can comprise a truck or other vehicle that supports other components of the system. For example, in exemplary aspects, it is contemplated that a bed of the truck or other vehicle can support various components of the system as further disclosed herein. It is contemplated that the gate of the rear hopper assembly, when opened, can be positioned to the rear of the spray assembly such that the spray assembly applies resin or epoxy components to a location on the roadway surface before the aggregate is dispensed at that location on the roadway surface. Thus, in use, the resin or epoxy components and the aggregate can be applied continuously, with the aggregate being applied to each portion of the roadway surface shortly after that surface has received the first and second resin or epoxy components. Optionally, the vehicle can have a hydraulic traction drive assembly that can be selectively activated to control the speed of the vehicle between 0 and 1 mile per hour to thereby stabilize and control the distribution of material onto the roadway surface.

DESCRIPTION OF THE DRAWINGS

FIG. 2A is a close-up side perspective view of a rear portion of the system. FIG. 2B is a close-up top plan view of a front portion of the system. FIG. 2C displays an exemplary configuration of the flow of resin components within the system, and FIG. 2D displays optional pumps for assisting with the flow of resin components.

FIG. 3A is a side perspective view of the gate assembly. FIG. 3B is a close-up view of the portion of the system depicted in FIG. 3A. FIG. 3C is a back view of the portion of the system depicted in FIG. 3A.

FIG. 11A is a side perspective view of the aggregate distribution assembly, while FIG. 11B is a back perspective view of the aggregate distribution assembly.

FIG. 12A is a back side perspective view of the aggregate distribution assembly, FIG. 12B is a rear elevational view of the aggregate distribution assembly, FIG. 12C is a side elevational view of the aggregate distribution assembly, and FIG. 12D is a front side perspective view of the aggregate distribution assembly. FIG. 12E is a close-up view of an auger and roller subassembly of the aggregate distribution assembly as disclosed herein.

DETAILED DESCRIPTION

Figure 1A:
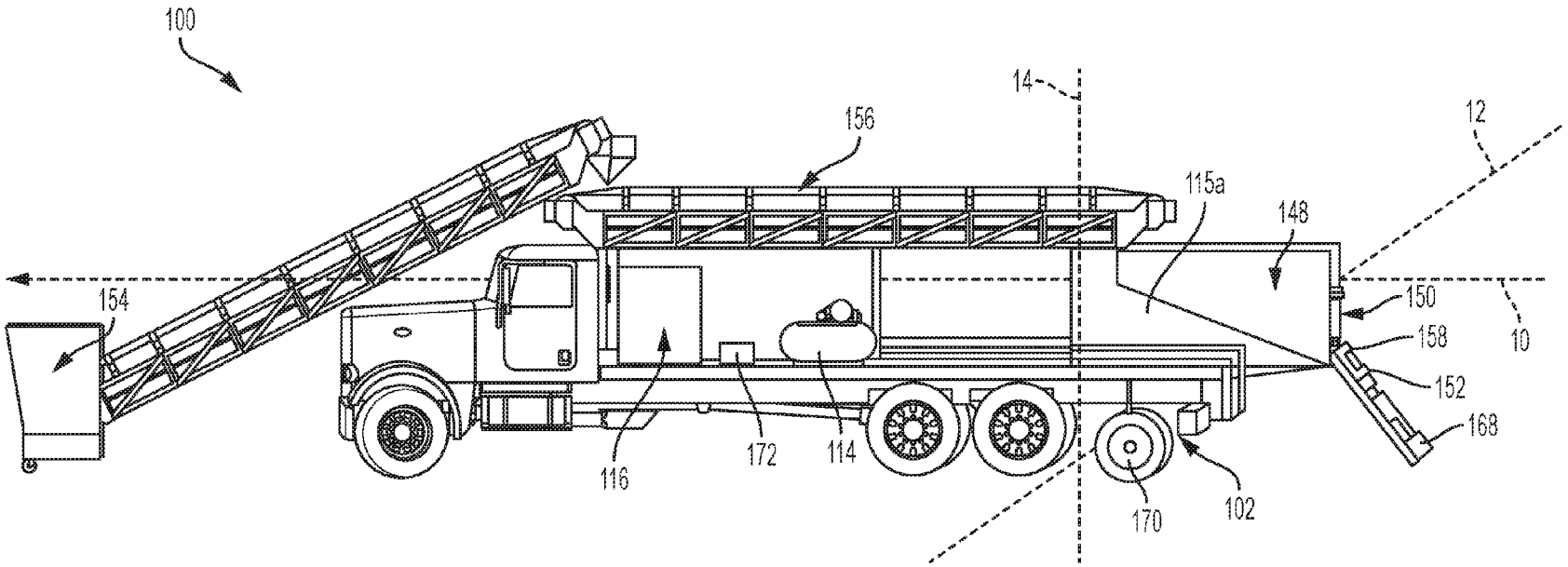
FIG. 1A is a right side perspective view of an exemplary system for applying a roadway surface treatment as disclosed herein.
Figure 1B:
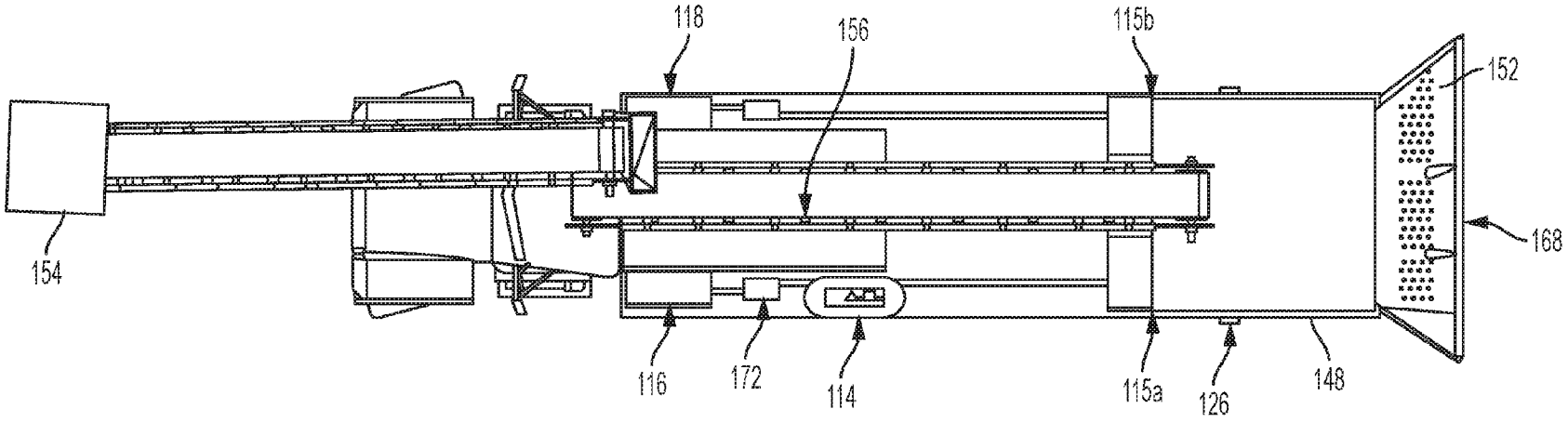
FIG. 1B is a top plan view of the system of FIG. 1A.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms “a”, “an”, and “the” include plural referents unless the context clearly dictates otherwise.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

Disclosed herein, in various aspects and with reference to FIGS. 1A-15 are systems and methods for applying a roadway surface treatment. In exemplary aspects, the system 100 can be positioned on (optionally, secured or mounted on) a vehicle 180, such as, for example and without limitation, a truck, that is moveable in a selected direction 10 that is generally parallel to or aligned with a longitudinal axis of the vehicle. Suitable trucks include flatbed trucks (e.g., 26-foot long flatbed trucks). In exemplary aspects, the vehicle 180 (e.g., truck) can comprise a hydraulic traction drive assembly 170 that is secured to the vehicle 180 (e.g., to the undercarriage or chassis of the vehicle). In these aspects, the hydraulic traction drive assembly 170 can be activated to control the speed of the vehicle such as, for example and without limitation, from 0 to about 1 mile per hour. In operation, with the truck in neutral, the hydraulic traction drive assembly 170 can be activated to apply downward pressure against the roadway surface and slowly advance the vehicle in a controlled manner. More particularly, the hydraulic traction drive assembly can comprise a hydraulic drive motor and at least one wheel apparatus 171 that is operatively coupled to the hydraulic drive motor and selectively movable from a stowed position (where the at least one wheel apparatus is not in contact with the roadway surface) and a deployed position (where the at least one wheel apparatus contacts the roadway surface). Optionally, it is contemplated that the hydraulic traction drive assembly can be moved about and between the stowed position and the deployed position using one or more actuators, such as, for example and without limitation, hydraulic actuators. In operation, the pressure between the at least one wheel apparatus and the roadway surface can be maintained at all times to ensure proper speed, directional movement, and production of the disclosed system. In exemplary aspects, the hydraulic traction drive assembly can comprise a pressure sensor to automatically adjust the applied pressure as the weight distribution and/or roadway profile changes during operation. In these aspects it is contemplated that the pressure sensor can be communicatively coupled to a processor of a system controller 190 (as further disclosed herein), which, in turn, can be communicatively coupled to the hydraulic drive motor to permit adjustment of the motor output to thereby control the pressure applied by the hydraulic traction drive assembly. Although described as being a hydraulic drive motor, it is contemplated that other motor types can be used to produce similarly functioning traction drive assemblies.

As further described herein, the disclosed system can contain and apply a multi-component surface treatment (e.g., resin and aggregate components) in a continuous manner.

Figure 2A:
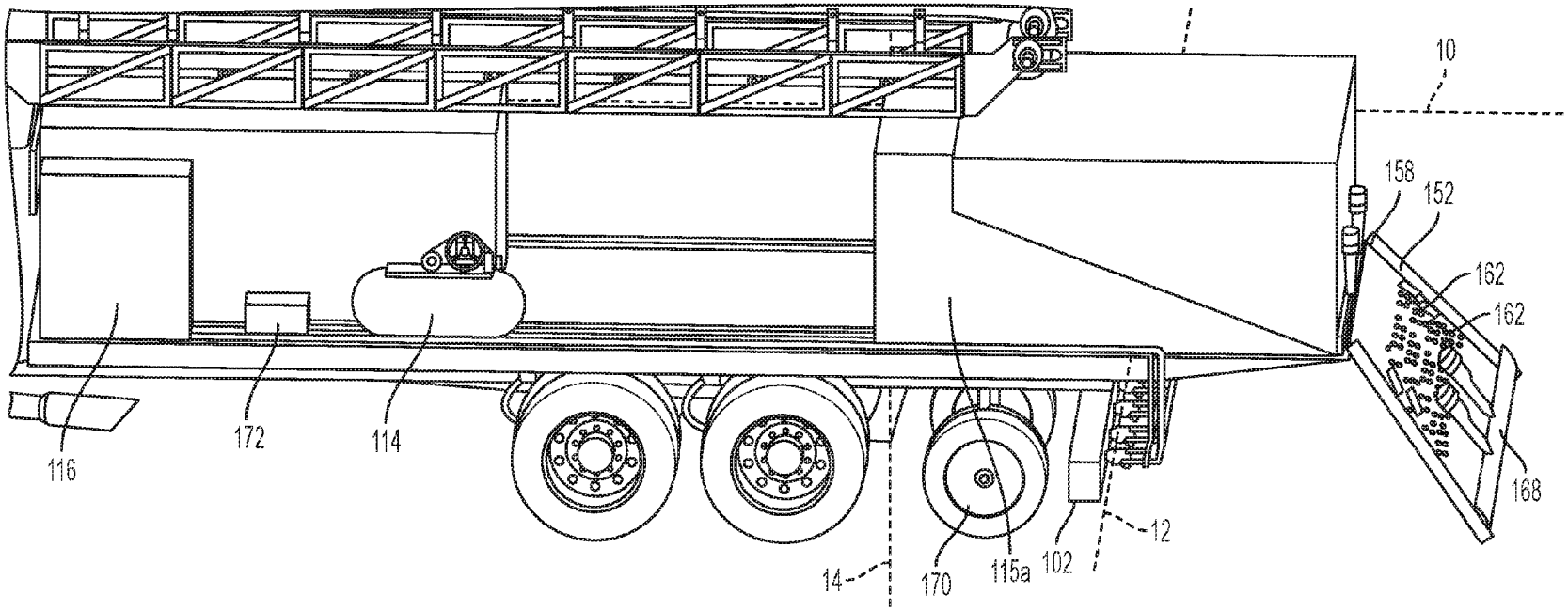
FIGS. 2A-2D are perspective close-up views of portions of an exemplary system for applying a roadway surface treatment as disclosed herein.
Figure 2B:
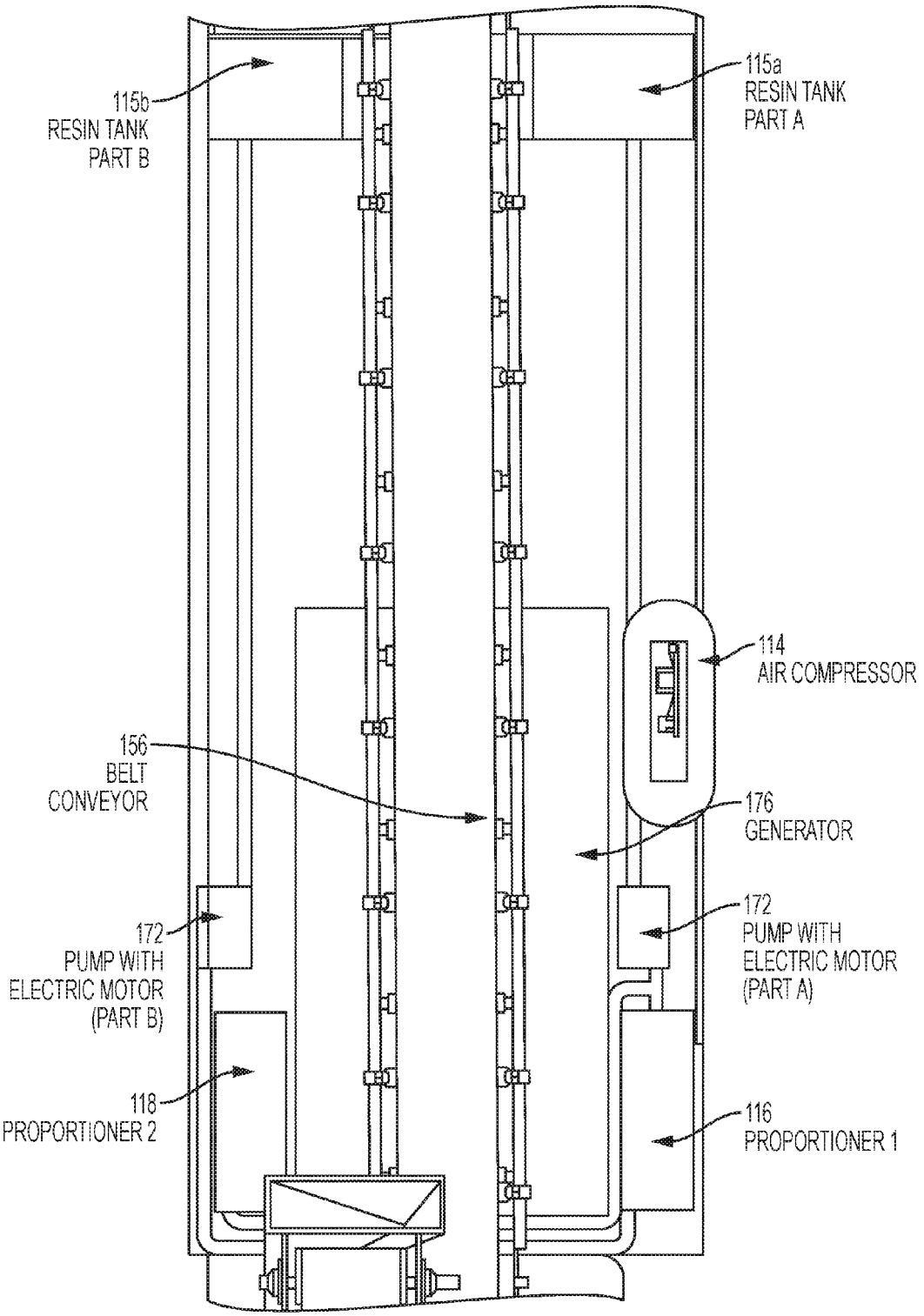
Figure 2C:
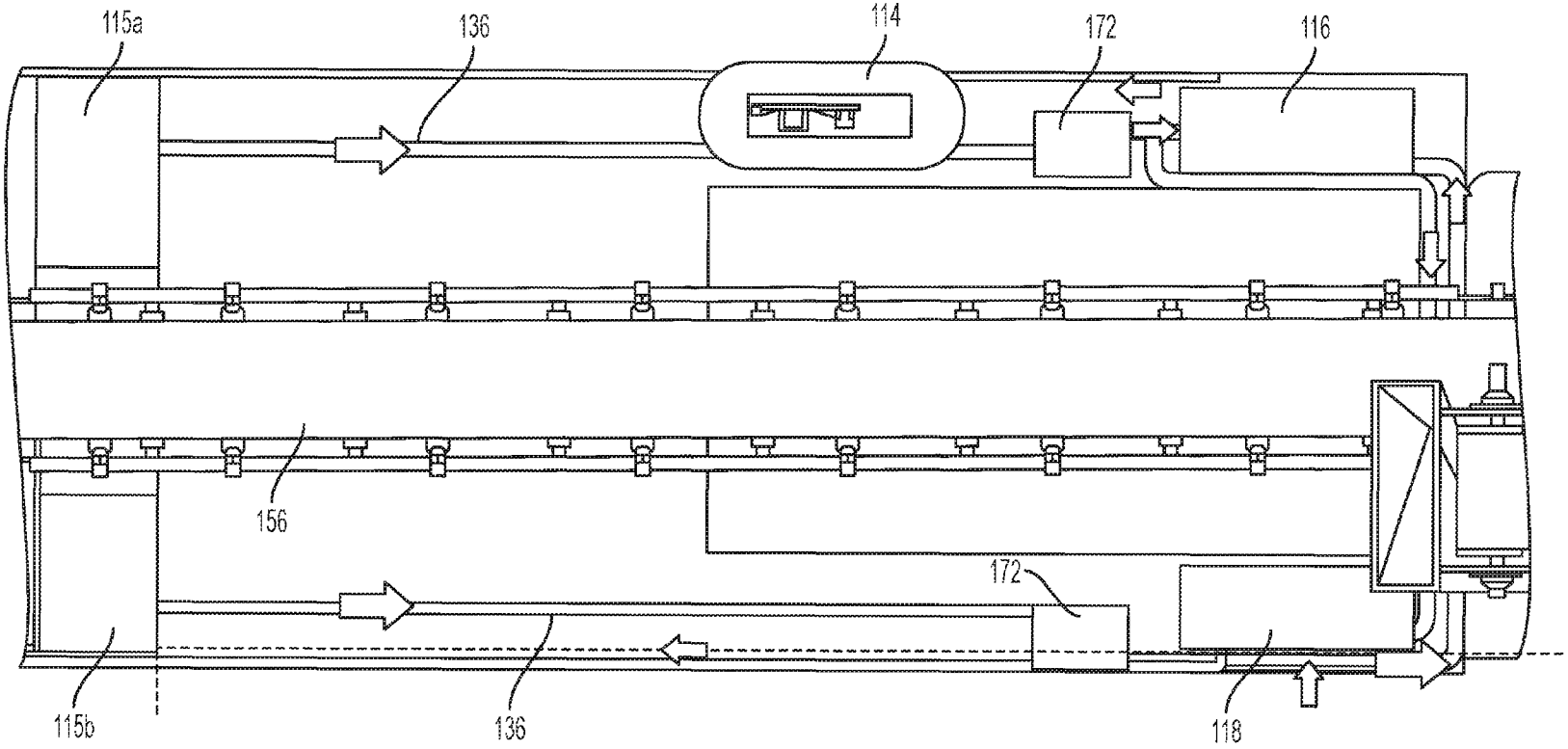
Figure 2D:
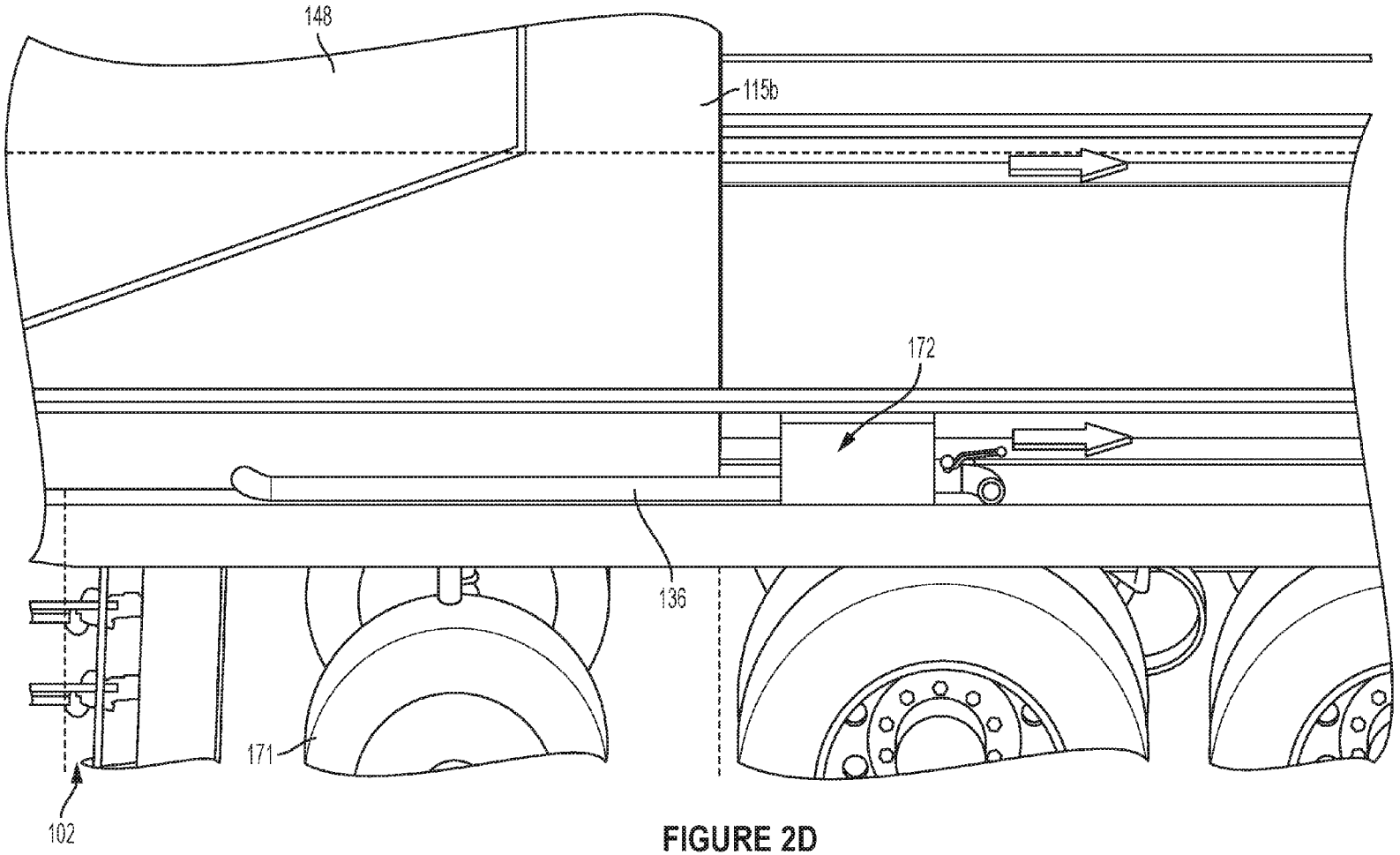
Figure 3A:
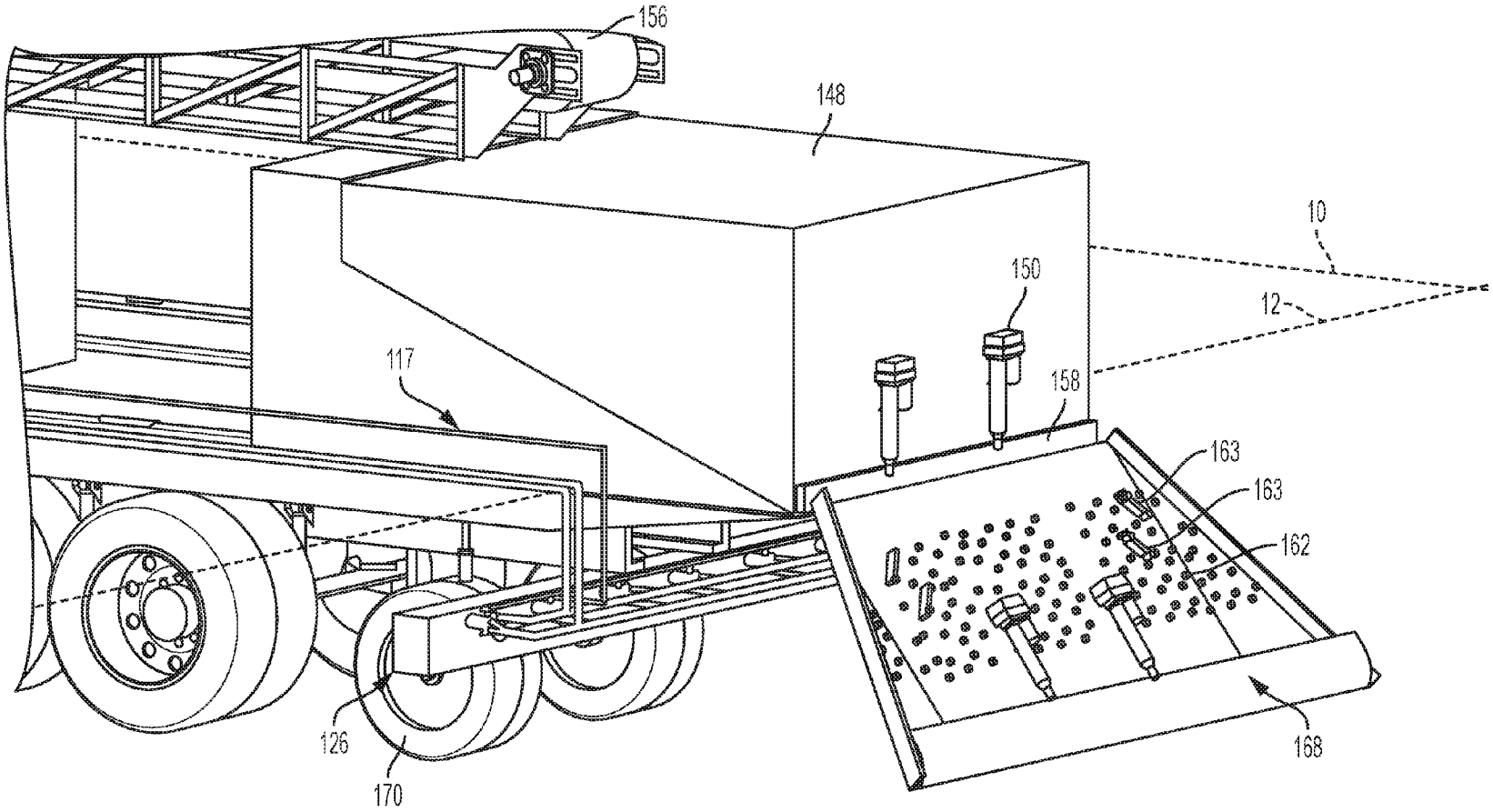
FIGS. 3A-3C are various perspective views of a rear portion of the system, including an exemplary spray assembly for dispensing a resin or epoxy as disclosed herein and an exemplary gate assembly for dispensing an aggregate material as disclosed herein.
Figure 7:
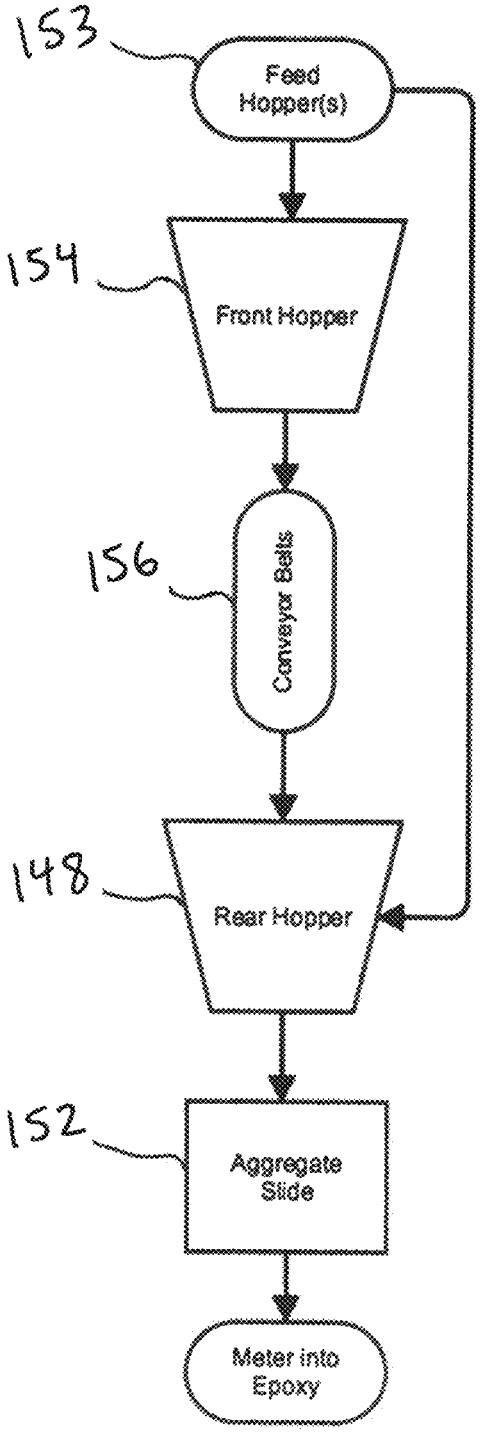
FIG. 7 is a schematic diagram depicting the flow of aggregate material to a hopper and aggregate slide as disclosed herein.
Figure 8:
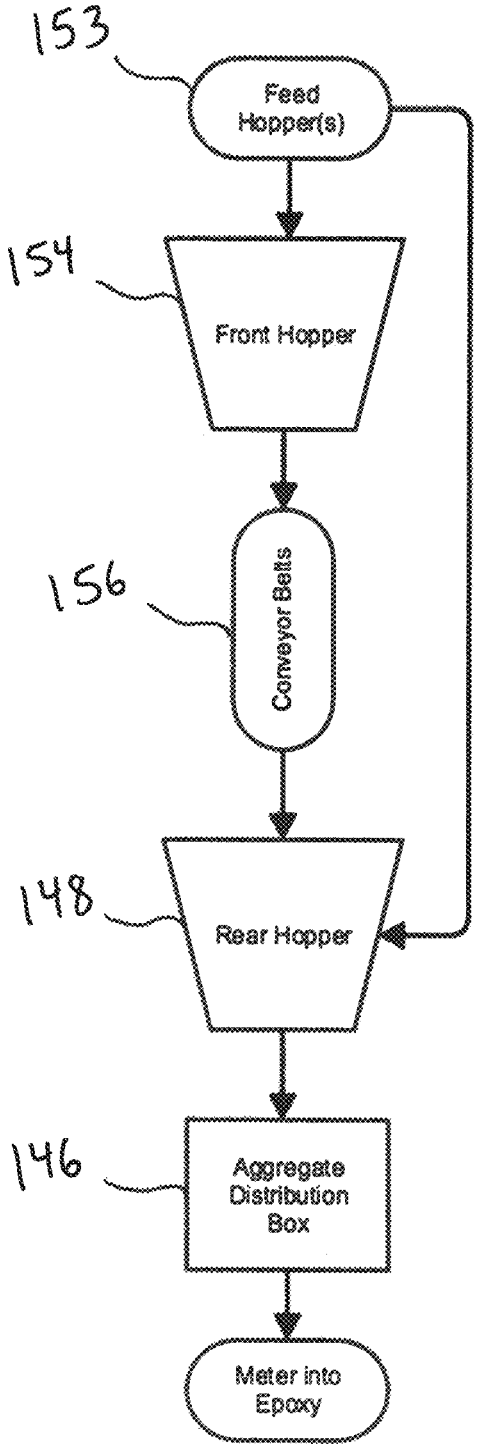
FIG. 8 is a schematic diagram depicting the flow of aggregate material to an aggregate distribution assembly as disclosed herein.

In exemplary aspects, the system can be configured to dispense epoxy resin from two containers (epoxy resin parts A and B; optionally, a 1:1 Ratio) 115*a*, 115*b*. However, it is contemplated that other binder agents and component ratios can be used. Similarly, it is contemplated that the system can comprise a single container or more than two containers for receiving epoxy resin components. Optionally, as shown in FIGS. 1A-3B, the first and second containers 115*a*, 115*b* can be positioned toward the rear of the vehicle 180. In exemplary non-limiting aspects, it is contemplated that at least a portion of the first and second containers 115*a*, 115*b* can be positioned below a rear hopper 148 as further disclosed herein. As shown in FIGS. 1A, 2A, and 3A, it is contemplated that the containers 115*a*, 115*b* can have a shape that is complementary to the shape of the rear hopper 148. Optionally, the containers 115*a*, 115*b* can be configured to receive epoxy resin components from one or more external tanks, and those epoxy resin components can optionally be delivered with the aid of one or more pumping assemblies as shown in FIGS. 7-8.

In further exemplary aspects, the aggregate dispensed by the system can optionally comprise calcined bauxite (for high-friction surface treatments) or flint (for bridge deck overlays). Optionally, the aggregates can be supplied in 4,000 lb supersacks as are known in the art. However, it is contemplated that the aggregate material can be supplied in any conventional manner.

In exemplary aspects, the disclosed system 100 can include a resin spraying apparatus 102. The spraying apparatus 102 can comprise various subcomponents including, for example, a plurality of spraying elements 104 (e.g., spray guns or spray nozzles), a spraying element positioning system 110, a resin pumping assembly 172, a resin mixing system 112, and a purging system 114. In use, parts A and B of the epoxy resin can be pumped from containers 115*a*, 115*b* by a resin pumping assembly 172 (optionally, a rotary ball pump) with an electric motor into the resin mixing system 112 (e.g., respective first and second proportioners 116, 118) at a pressure ranging from about 50 psi to about 100 psi, with the epoxy resin components being preheated if necessary. In exemplary aspects, the pumping assembly 172 can comprise a GRANCO Rotary Ball Pump with Cardan-type universal joint having main shaft and idler shaft that rotate relative to one another and corresponding lugs as are known in the art.

In exemplary applications, the proportioners 116, 118 of the resin mixing system 112 can be configured to meter parts A and B at a desired pressure (e.g., a pressure ranging from about 1,000 psi to about 2,000 psi or at approximately 1,500 psi). In exemplary non-limiting aspects, the proportioners 116, 118 can comprise POLYMAC-USA "Classic" PH/PHX-40 Hydraulic Proportioners (Polyurethane Machinery Corporation). Optionally, the proportioners can meter parts A and B down heated lines with thermocouples (Polyurethane Machinery Corporation) near the ends of the lines to regulate temperature to the spraying elements 104 (e.g., spray guns or spray nozzles), which are mounted on the vehicle 180. As further disclosed herein, the spraying elements 104 can be mounted at a desired height relative to the roadway surface and can be spaced apart in a desired configuration to produce a desired spray pattern. Optionally, in exemplary aspects, the spraying elements 104 can be positioned about three feet above a roadway surface (e.g., an asphalt/concrete surface) and spaced approximately 5 to 25 inches apart. In exemplary aspects, it is contemplated that the spraying apparatus 102 can comprise 5 to 25 spraying elements 104 spread apart over a 10-18 foot wide pattern (typical road width). In exemplary non-limiting aspects, the spraying elements 104 disclosed herein can comprise an AF2929 Mix Chamber (00) with FT0838 flat tip, medium flow, 16 inch pattern and a Graco FUSION™ plural component, impingement mix air purge spray gun (Graco Inc.). Alternatively, in other aspects, the spraying elements 104 disclosed herein can comprise airless spray guns, such as, for example and without limitation, an automatic airless spray gun (Graco Inc.). In still further exemplary aspects, it is contemplated that the spraying elements can comprise spray nozzles. Optionally, in these aspects, the spray nozzles can comprise a filter, a check valve, and a spray tip as are known in the art. In exemplary aspects, the check valve for each spray nozzle can be a 5 psi check valve. Optionally, in further exemplary aspects, it is contemplated that the plurality of spray nozzles can be secured to and in communication with a manifold 120, which in turn is secured to and in communication with at least one hose that delivers material to the manifold 120. In these aspects, the manifold 120 can define a plurality of openings 121, and each spray nozzle can be secured within a respective opening of the manifold. Optionally, in still further exemplary aspects, it is contemplated that each spray nozzle of the plurality of spray nozzles can be secured to and in communication with a respective hose 122, which in turn is secured to and in communication with a manifold 120 that receives material to be delivered to the spray nozzles. In exemplary aspects, the manifold 120 can be defined within a mount assembly 126 as further disclosed herein. Although some of the Figures disclose the spraying elements as spray guns or spray nozzles, it is contemplated that either type of spraying element can be used in any of the configurations disclosed and depicted herein.

As further disclosed herein, a plurality of spraying elements 104 can be used to distribute the resin to the ground. In an aspect of the disclosure, the flow rate of resin through each spraying element 104 can be adjusted through tip opening or pressure. The flow rate can be manually adjusted. In another aspect the system controller 190 can automatically adjust the flow rate through a particular spraying element 104. Each spraying element 104 can include an individual flow regulator that provides feedback to the system controller 190, allowing for a subsequent flow adjustment signal to be provided by the system controller. In another aspect, a single flow regulator can be positioned before (upstream of) a tubing branch 124 to uniformly regulate the flow to the entire plurality of spraying elements.

Figure 9:
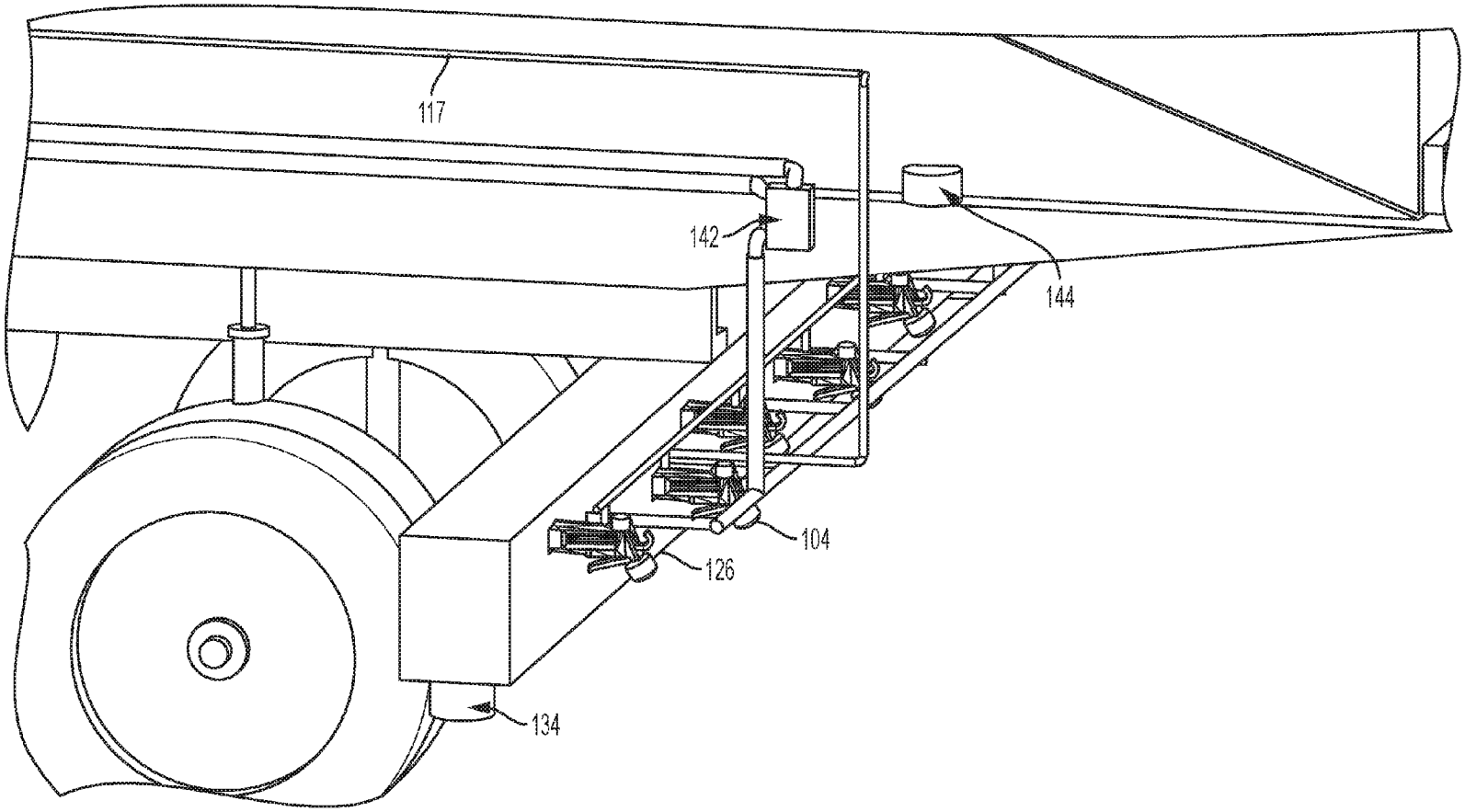
FIG. 9 is a perspective close-up view of a spray gun mount assembly as disclosed herein.

The spraying element positioning system 110 can comprise a structure attached to the rear of the truck (or other vehicle) 100 that allows for three-dimensional positioning of an individual spraying element 104 or group of spraying elements relative to the rear of the truck. Optionally, the spraying element positioning system 110 can comprise a mount assembly 126 that extends along the rear of the truck as shown in FIG. 9. In exemplary aspects, the spraying element positioning system 110 can comprise a frame 111 that is coupled to the mount assembly 126 and configured for selectively adjustable positioning (axial movement or rotation) relative at least one axis, such as the transverse axis 12 or the vertical axis 14. Optionally, it is contemplated that the frame 111 can be operatively coupled to at least one actuator (e.g., a linear actuator) that is configured to effect movement of the frame and, thus, the mount assembly 126 and the spraying elements 104. In exemplary aspects, the at least one actuator of the spraying element positioning system 110 can be communicatively coupled to the system controller 190 as further disclosed herein.

In exemplary aspects, the mount assembly 126 can be provided as a railing member that is part of a spraying element rail system 128, which can comprise at least one rail member 129 extending along at least a portion of the width of the vehicle 180 relative to a transverse axis 12. The spraying element rail system 128 can allow a spraying element 104 or spraying elements to be adjustable along the width of the rear end of the truck. Generally, each spraying element 104 can comprise a connector (e.g., fastener) that releasably and adjustably engages a selected rail member 129. The degree of freedom between the spraying element 104 and rail member 129 can allow for selective positioning of the spraying element along the length of the rail member. In one aspect, the position of each spraying element 104 relative to the rail member 129 can be manually adjusted. In another embodiment, the adjustment can be automated by an actuation mechanism, where the location along the rail member is selectively adjustable in response to commands received from the system controller 190. Optionally, the at least one rail member can comprise a plurality of rail members that are spaced apart relative to a vertical axis 14, thereby permitting selective adjustment of the vertical position of a given spraying element 104.

In an exemplary aspect, the connection between a rail member 129 and a spraying element 104 can allow for a spraying element or plurality of spraying elements to be adjustably positioned relative to the movement direction 10 and the longitudinal axis of the vehicle 180 (e.g., to extend closer to or farther away from the rear of the truck). In this aspect, it is contemplated that each spraying element can comprise an extending member 127 that is configured for selective axial advancement or retraction relative to the movement direction 10 and the longitudinal axis of the truck. Optionally, it is further contemplated that the extending member 127 of each spraying element can be oriented in a direction approximately perpendicular to the railing member (and substantially parallel to the longitudinal axis of the truck). In exemplary aspects, each extending member can comprise a telescopic shaft assembly in which a distal portion of each spraying element supports an outlet of the spraying element and is slidably coupled to a proximal portion of the spraying element that is coupled to the mount assembly 126.

Figure 10A:
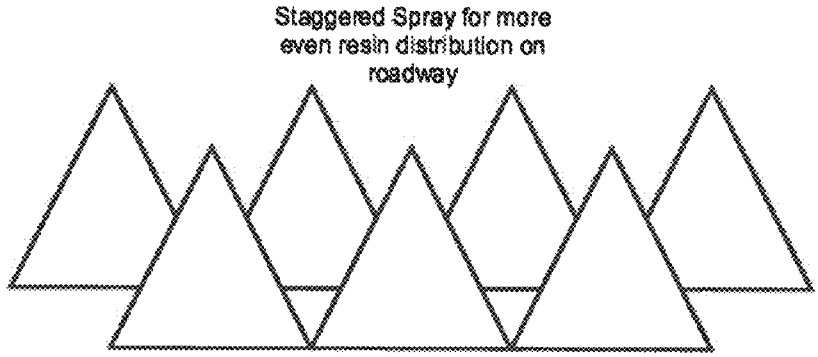
FIGS. 10A-10C schematically depict exemplary resin distribution arrangements that can be achieved by various staggered orientations of the spraying elements disclosed herein.
Figure 10B:
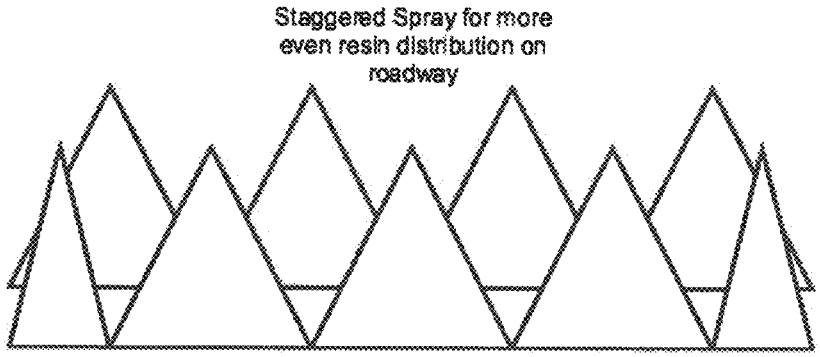
Figure 10C:
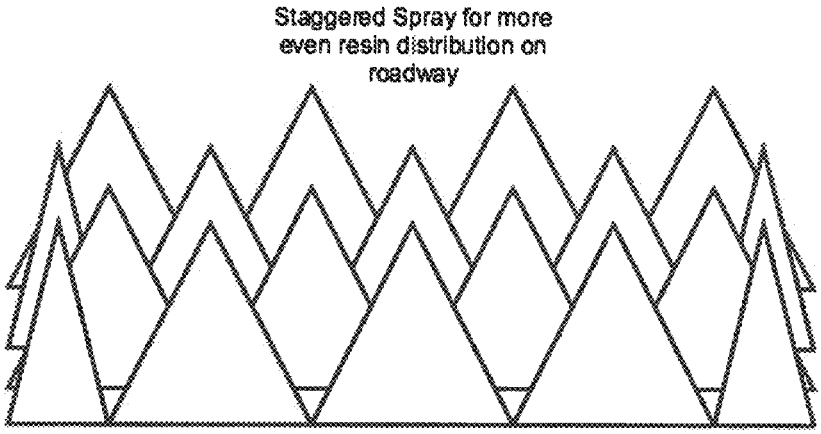
Figure 11A:
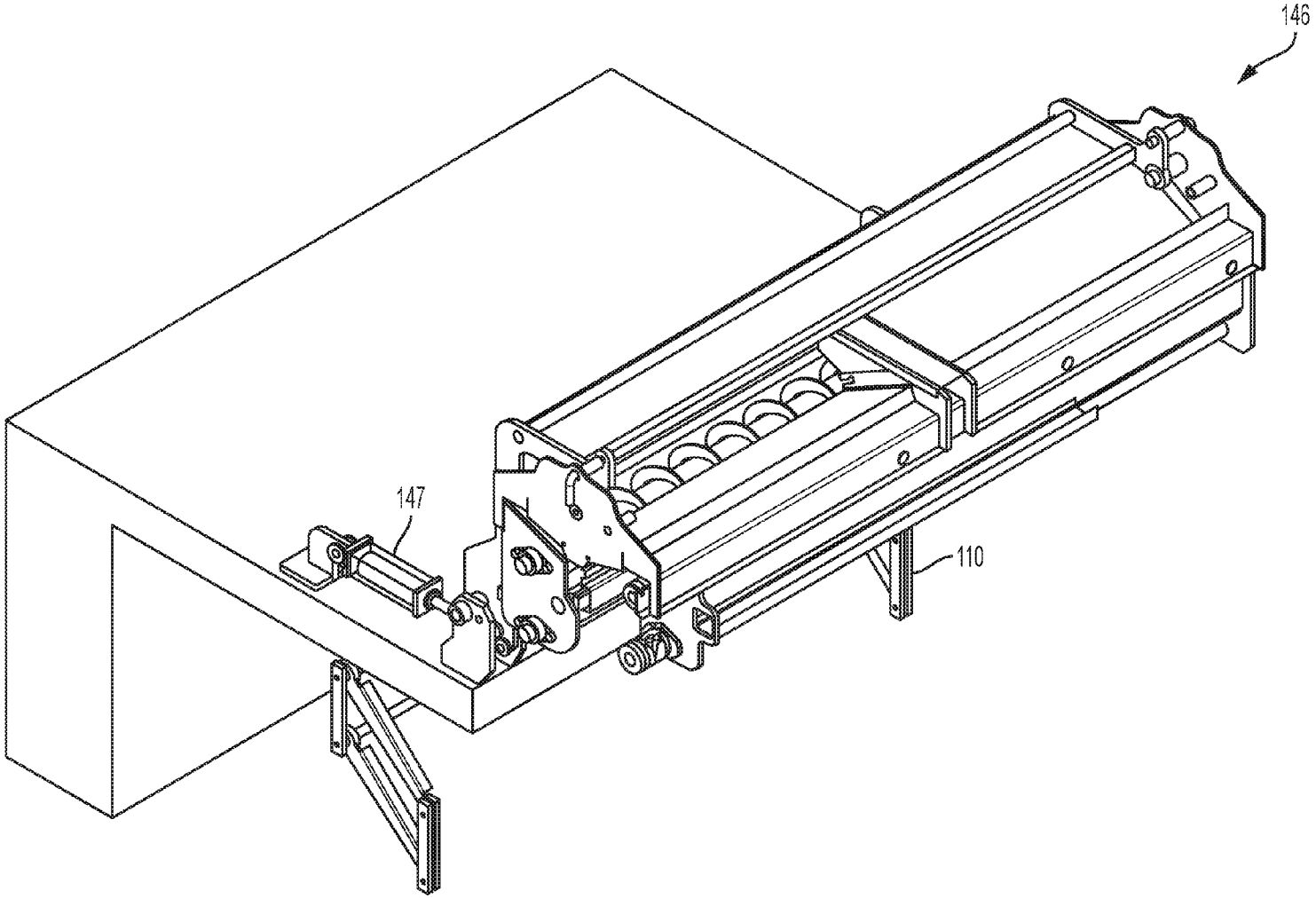
FIGS. 11A-11B are isolated perspective views of an aggregate distribution assembly and spray assembly articulation system for articulating the spray assembly vertically or horizontally as disclosed herein, with the distribution assembly shown in a retracted/stowed position.
Figure 11B:
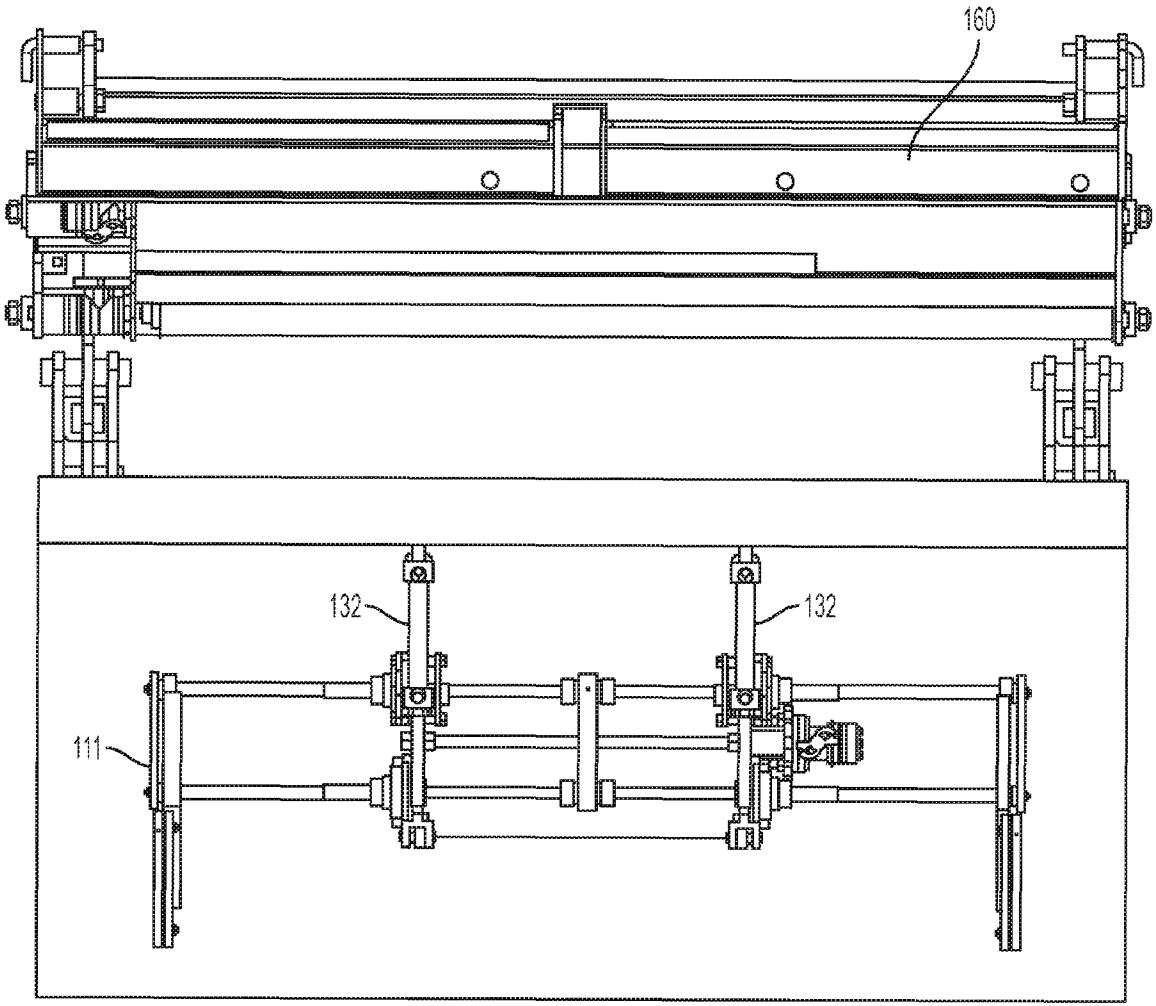
Figure 12A:
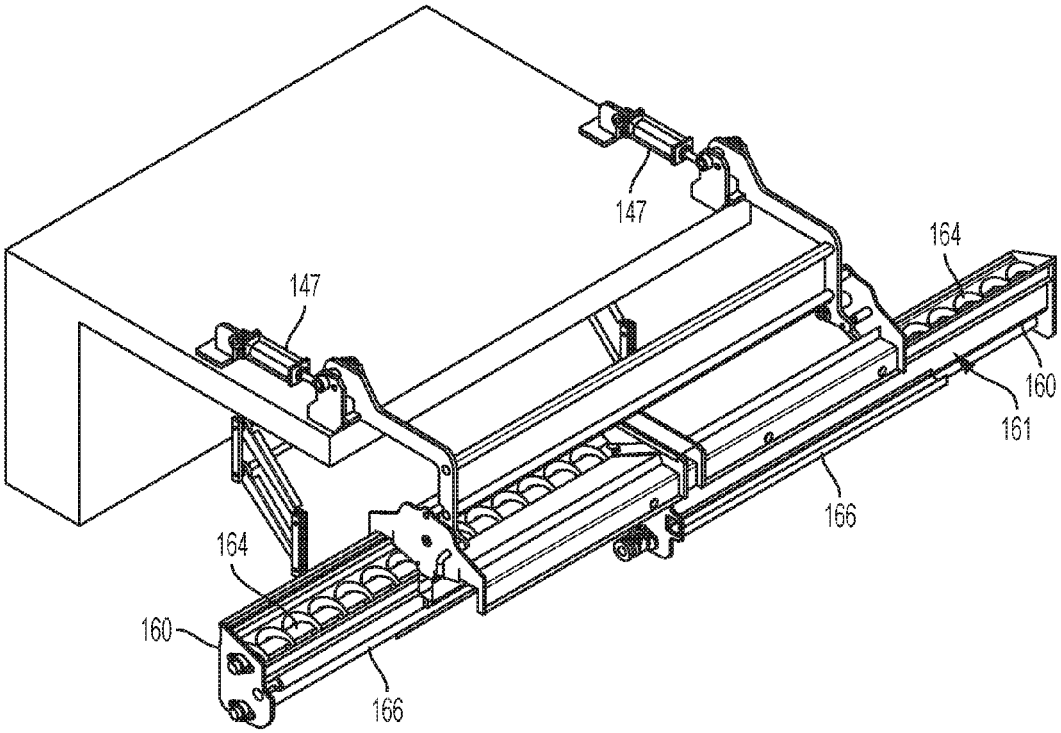
FIGS. 12A-12E are isolated perspective views of the aggregate distribution assembly of FIGS. 11A-11B, with the distribution assembly shown in an extended/use position.
Figure 12B:
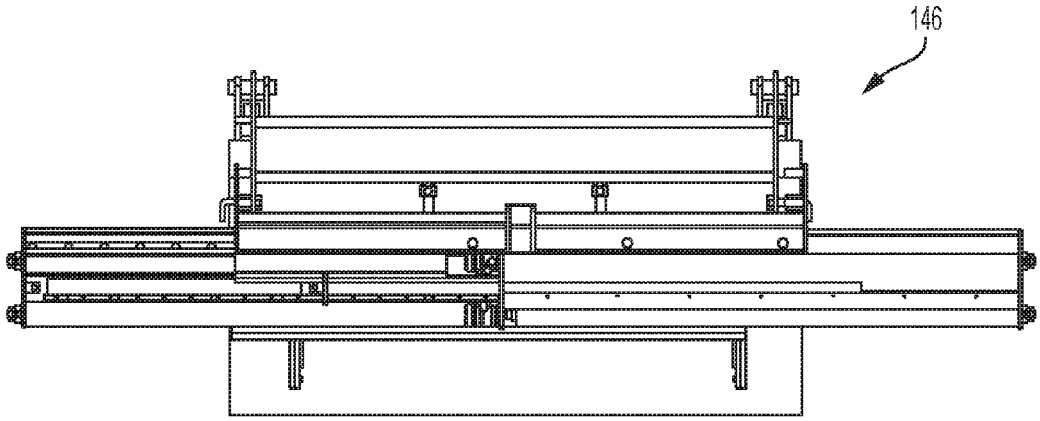
Figure 12C:
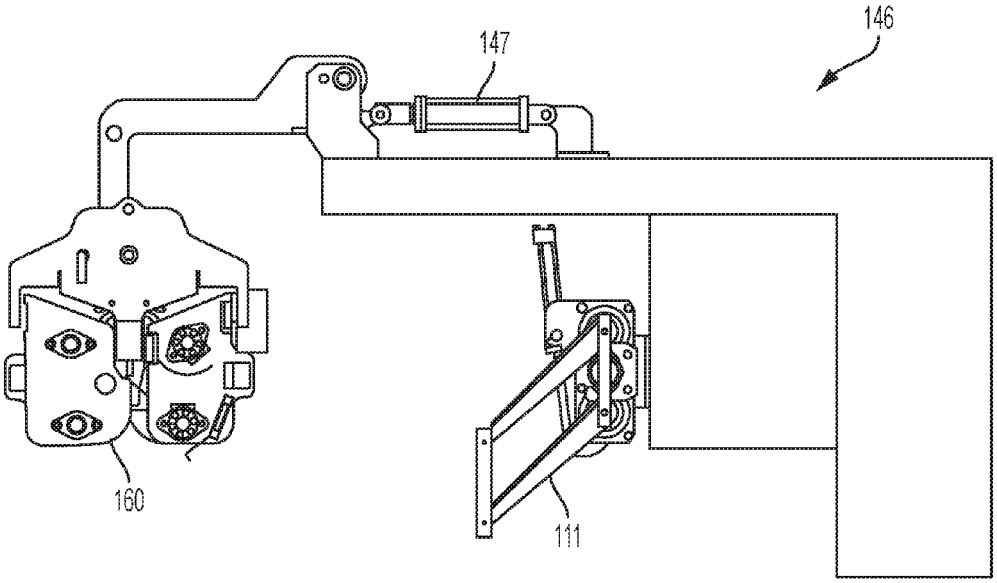
Figure 12D:
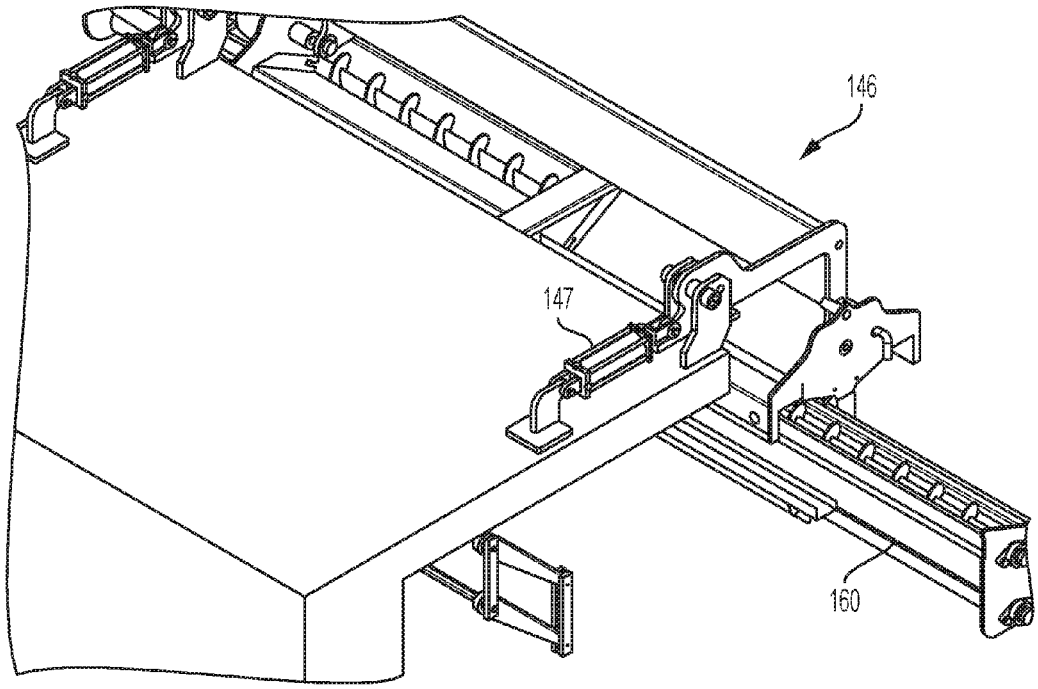
Figure 12E:
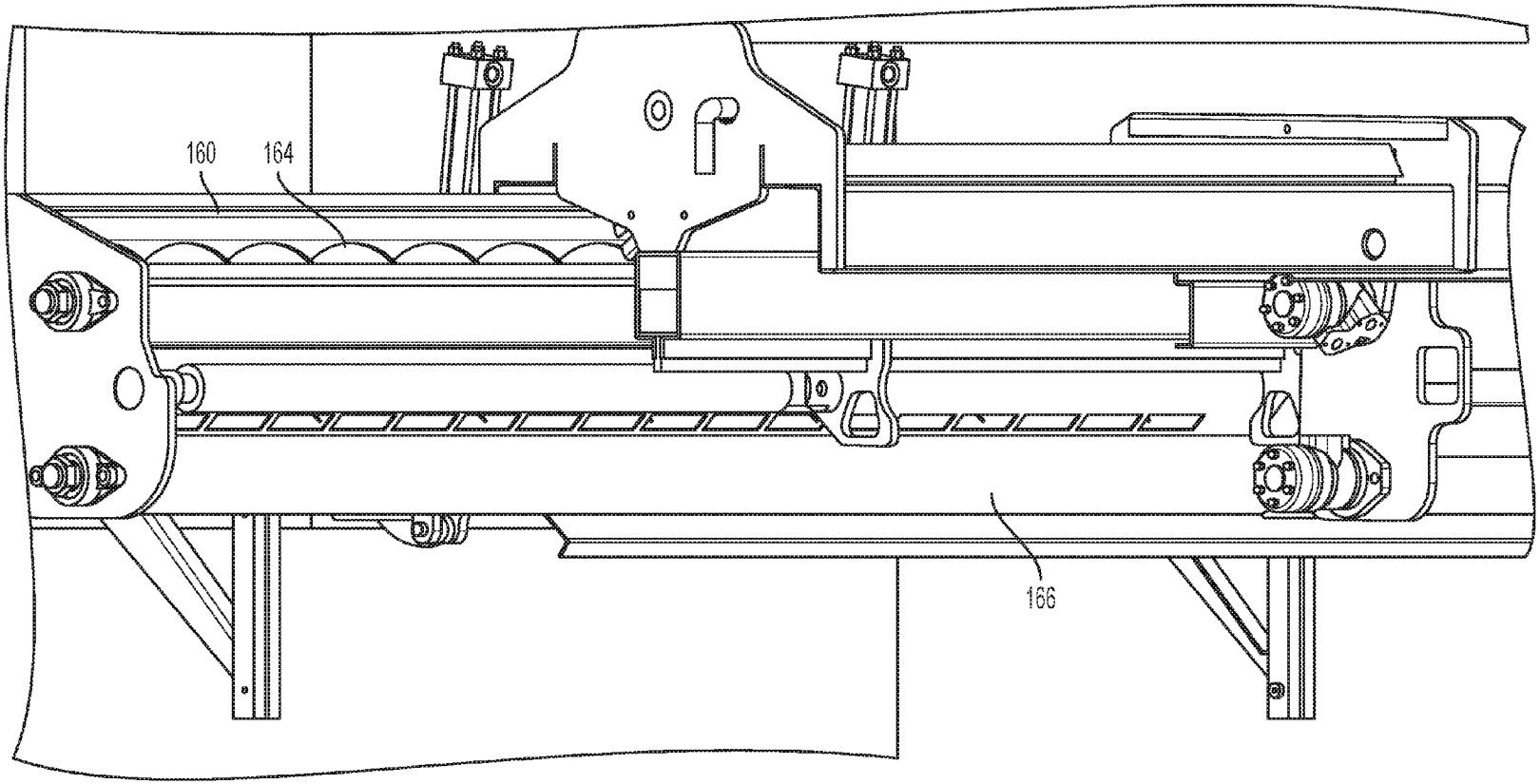

As shown, the mount assembly 126 (rail member 129) can define one or more horizontal rail members 129 (e.g., tracks) that receive portions of the spraying elements 104 and permit selective secure attachment of the spraying elements 104 to the mount assembly. Optionally, the spraying elements 104 can be positioned so that they are uniformly distributed along the width of the truck rear. Additionally, in further optional aspects, the position of the spraying elements 104 relative to the longitudinal axis (and the direction of movement 10) of the truck can be selectively adjusted. Overall, the variation between the horizontal positioning and extension of the spraying element 104 allows a user to stagger the arrangement of the spraying elements 104. The staggered arrangement can provide for greater distribution of the resin when applied to the pavement. Exemplary resin distributions are shown in FIGS. 10A-10C, in which each triangular region schematically depicts the spray of resin by a respective spraying element. Accordingly, the distance between each spraying element 104 can vary. In another aspect, each spraying element 104 can have the same height relative to the ground being paved. In addition, alternatives are possible where the height of each spraying element 104 relative to the ground varies. In exemplary aspects, and as shown in 11A-12E, the frame 111 and the mount assembly 126 of the spraying apparatus 102 (and the spraying elements) can be selectively moveable relative to the vertical axis 14 and/or transverse axis 12 that is perpendicular to the longitudinal axis of the truck (and the movement direction 10). In these aspects, it is contemplated that the frame 111 can comprise opposed arms that are secured to respective ends of the mount assembly 126 and coupled to an actuation mechanism 132 for effecting the desired movement of the spraying apparatus 102. In exemplary aspects, the actuation mechanism 132 can comprise hydraulic actuators or other conventional actuators for effecting linear movement. Optionally, the actuators can be communicatively coupled to the system controller 190 as further disclosed herein.

Optionally, as shown in FIGS. 11A-12E, the rail system 128 can also include a leveling mechanism 134. The leveling mechanism 134 can be configured to ensure the mount assembly 126 (rail member) and thus, the rail system 128, is substantially parallel to the ground. The leveling mechanism 134 can comprise one or more leveling regulators as are known in the art. In other aspects, the leveling regulators can comprise laser sensors, ultrasonic sensors, and the like for evaluating whether the mount assembly is level. In one exemplary aspect, leveling regulators can be placed at opposed ends of the mount assembly. However, alternative locations for the leveling regulators are possible. In use, the leveling regulators can be configured to evaluate the height between the sensor and the ground. In use, variations in the detected height between the sensors and the ground can provide an indication of an undesired orientation of the spraying apparatus 102.

The leveling regulators can also provide data to and receive data from the system controller 190. The feedback from the system controller 190 can be used to a manually adjust the railing system. In another aspect, the rail system 128 can comprise leveling actuators coupled to the railing structure, and the leveling actuators can be configured to automatically level the rail system 128 based on a feedback signal received from the system controller.

In use, when the spraying elements 104 comprise spray guns, the spray guns can have triggers that are pulled by a housing that is coupled to a pneumatic actuator (e.g., a Sprayworks pneumatic actuator) when a switch is turned on, activating all guns (though individual guns can be turned off with valves). Alternatively, the spray guns can be automatic airless spray guns as are known in the art that deliver material via fluid pressure.

In use, when the spraying elements 104 comprise spray nozzles, the spray nozzles can dispense material as it is applied to the spray nozzles, with the rate of material flow being determined by upstream flow control mechanisms and/or fluid pressure as further disclosed herein.

Optionally, the spraying elements 104 can share lines for the Part A component and the Part B component. In exemplary aspects, the system 100 can comprise means for detecting a pressure change or a drop in pressure below a certain threshold. In exemplary aspects, the means for detecting the pressure change/drop can comprise pressure sensors (not shown) positioned inline near the spraying elements (e.g., two pressure sensors per spraying element—one for Part A, one for Part B). In exemplary aspects, the pressure sensors can comprise Anfield SKBA/SKBF miniature pressure switches (Anfield Sensors Inc.).

In use, it is contemplated that the system 100 can comprise a piping system 136 for the resin (or other desired materials) that allows the proportioners 116, 118 to work together to maintain a desired pressure at the spraying elements. The piping system 136 and the proportioners 116, 118 can keep the spraying elements 104 in parallel with equal support for each spraying element from any number of proportioners 116,118 added to the system 100. It is contemplated that the piping system 136 can provide fluid communication between the containers 115*a*, 115*b*, the proportioners 116, 118, and the spraying elements 104 as further disclosed herein. The piping system 136 can have a collection of valves that allow for easily purging or using one or more spraying elements and purging the lines of the piping system 136 before starting. Optionally, it is contemplated that the spraying elements 104 can be purged with solvent flush across each respective spraying element at the end of an application process. In these aspects, the spraying elements 104 can optionally be positioned in fluid communication with a purging system 114 as further disclosed herein, which can include a solvent flush assembly, such as for example and without limitation, a Merkur® Non-Heated Spray Package (Graco Inc.).

In exemplary aspects, the resin can be mixed in at least one mixing chamber 142 positioned between and in fluid communication with the proportioners 116, 118 and the spraying elements 104. In a further aspect, it is contemplated that the mixing chamber 142 can comprise a static mixer. In general, the components of the resin can be forced into an end of the mixing chamber 142. Applying the fluid flow principles of the static mixer 142, the resin can be properly mixed. Alternative embodiments for the design of static mixer can be implemented. For example, it is contemplated that the static mixer can comprise additional (multiple) mixing chambers depending on the amount or type of resin to be used. In exemplary aspects, the static mixer can be a mix manifold as is known in the art, such as, for example and without limitation, a single-flush or dual-flush mix manifold manufactured by Graco Inc.

Thus, it is contemplated that Parts A and B of the resin can be mixed in the chamber 142 through either impingement or static mixing and then uniformly distributed on the roadway surface at a substantially constant rate. As the Hydraulic Traction Drive is activated to move the truck forward, it maintains a constant speed to ensure proper mil thickness (typically, 60 mils for high-friction surface treatments) on the roadway surface.

In other aspects, the spraying apparatus 102 can comprise a purging system 114. In general, the purging system 114 can be an auxiliary system used to prevent residual resin from building up in the resin spraying apparatus 102. Over time, residual resin can decrease the overall performance of the spraying apparatus. The purging system 114 can include a tank 144 that contains a purging solvent solution and is positioned in selective fluid communication with the piping system 136. During a purging cycle, the purging solvent solution can be introduced to the resin spraying apparatus 102 and flush the residual resin from the system 100. The purging solvent can dissolve and transport any residual resin that is still present in the apparatus. In a further aspect, the presence of residual resin can be monitored using sensors that provide feedback to the system controller 190 as further disclosed herein. The system controller can accordingly regulate the amount of solvent solution to flush the resin spraying apparatus. In another aspect, the purging system 114 can include an air purging subsystem, such as, for example and without limitation, an air compressor positioned in fluid communication with the spraying elements 104 through a purging line 117. The air purging subsystem can be used in tandem with, or separately from (e.g., after) the solvent purging subsystem. The air purging subsystem can be used to remove the purging solvent solution in the spraying apparatus. In a further aspect, a similar configuration of sensors can be used to automate regulation of the air purging sub system.

Figure 13:
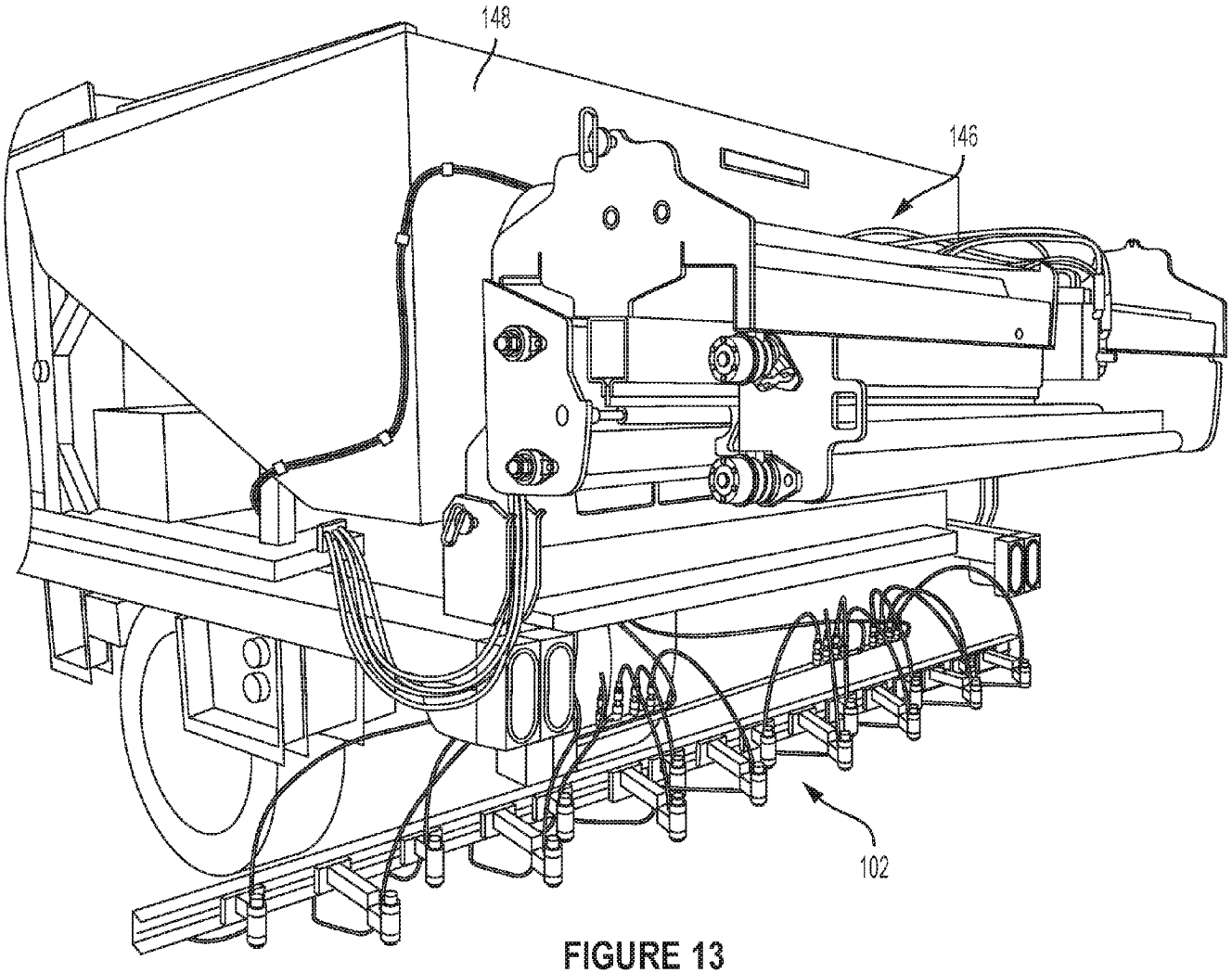
FIG. 13 is an image depicting the rear of an exemplary system as disclosed herein, with the aggregate distribution assembly in the retracted/stowed position.
Figure 14A:
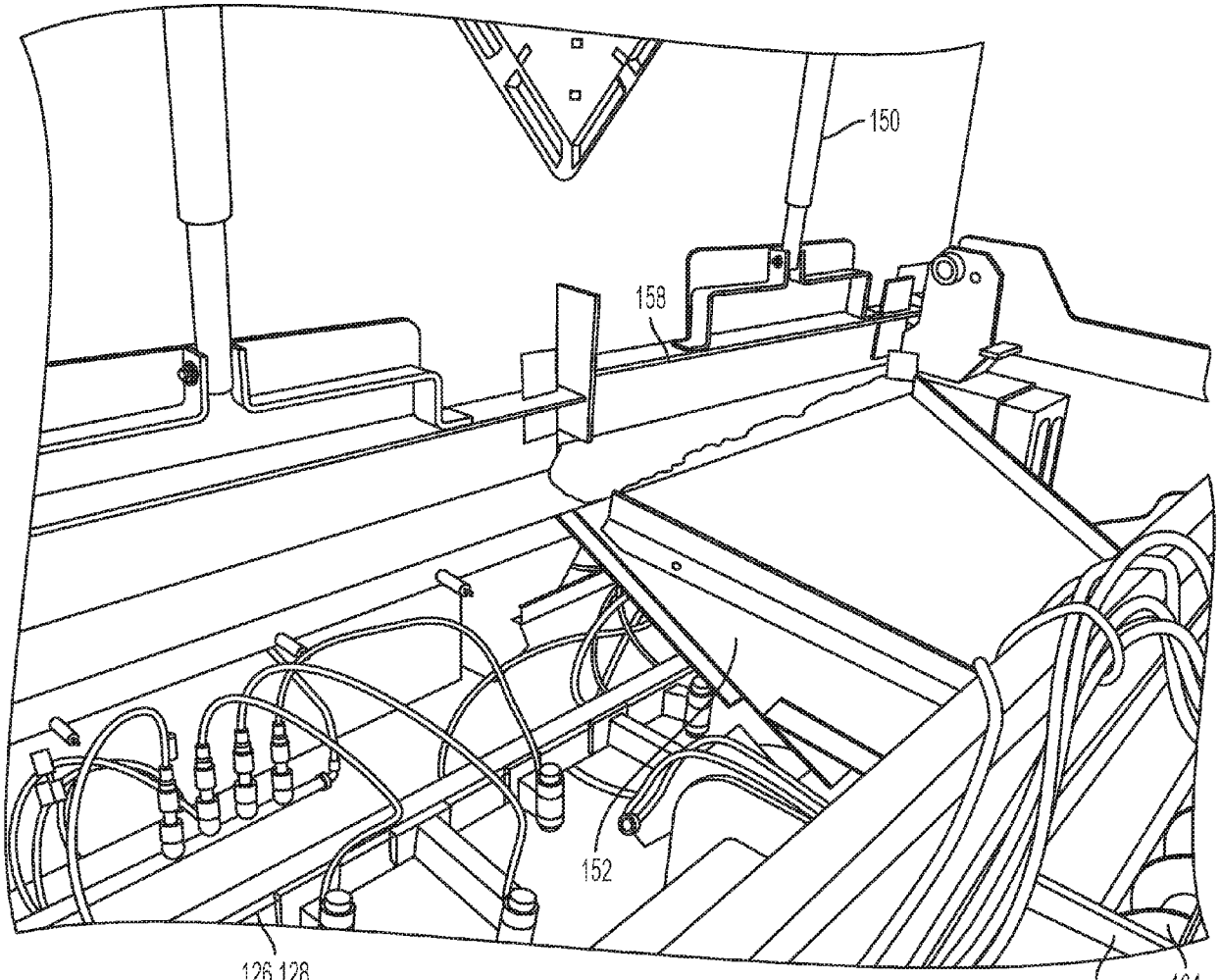
FIG. 14A is an image that shows various portions of an aggregate distribution assembly as disclosed herein, with the aggregate distribution assembly in the extended/use position.

In exemplary aspects, the disclosed system 100 can comprise an aggregate distribution assembly. Optionally, in some aspects, and as shown in FIGS. 8 and 11A-14B, the aggregate distribution assembly 146 can comprise a rear hopper 148, at least one linear actuator 150, an aggregate slide 152, at least one trough 160, and at least one dispensing roller 166. In general, the aggregate can be received in the rear hopper 148 from a hopper 154 in the front or to the side of the truck. The aggregate can be carried to the rear hopper 148 by a conveyor belt assembly 156 as shown in FIGS. 1C and 2B-2C. Alternatively, the aggregate can be provided to the rear hopper 148 by a feed hopper 153 (without the need for a conveyor belt assembly 156). Once in the rear hopper 148, a lift gate (or a plurality of lift gates) at the rear of the truck can be selectively opened to allow the aggregate to be dispensed. The lift gate 158 can be opened manually or using a linear actuator 150. The aggregate can pass through the lift gate 158 and then onto an aggregate slide 152 as shown in FIG. 14A. The aggregate slide 152 descends downwardly relative to the rear hopper and can use gravity to transfer the aggregate into a trough 160. Optionally, it is contemplated that the rear hopper 148 can have a bottom surface that is sloped downwardly moving in a rearward direction (away from the direction of movement of the vehicle), thereby promoting flow of aggregate material toward the lift gate and the aggregate slide 152. Optionally, the aggregate distribution apparatus can comprise a vibratory motor or other vibration mechanism that is configured to vibrate at least one of the rear hopper 148 or the aggregate slide 152 to promote movement of the aggregate material. Once the aggregate has exited the aggregate slide 152 and entered the trough 160, the aggregate can be distributed evenly within the trough via an auger assembly as further disclosed herein.

In an aspect, the rear hopper 148 can receive the aggregate from the front hopper via the conveyor belt. Optionally, the rear hopper can define multiple chambers, with each chamber being configured to receive a different aggregate component.

The lift gate 158 of the rear hopper 148 can be a removable component of a rear wall/surface that defines the hopper 148. The lift gate 158 is generally located at the bottom of the rear wall of the hopper 148 and is configured for selective vertical movement relative to the adjacent portions of the rear hopper wall to permit selective creation of an opening in the rear wall. When opened, the lift gate 158 allows gravity to force aggregate from the rear hopper 148 into the aggregate slide as disclosed herein. The lift gate 158 can be opened manually by using an opening mechanism that disengages the lift gate 158 from the wall. Alternatively, a linear actuator 150 can automate the mechanical force needed to open the lift gate 158. For embodiments with multiple chambers, a lift gate 158 can be used for each respective chamber, with either a manual implement or an automated linear actuator operating each lift gate 158.

As discussed earlier, the transition from the rear hopper 148 to the trough 160 can be completed using an aggregate slide 152. In general the aggregate slide 152 can be a ramp that descends in to the trough 160 to provide communication between an outlet end of the slide and an inlet end of the trough. When multiple lift gates 158 are provided at the rear of the hopper 148, the respective openings of the hopper that are exposed when the lift gates 158 are opened can be positioned in communication with respective aggregate slides 152. In other aspects, the aggregate slide 152 can include protrusions or projections (e.g., dowels 162) that are arranged to aid in managing the flow of the aggregate to the trough(s) 160. In another embodiment, the slides 152 can include side walls that prevent aggregate from exiting the slide before reaching the trough 160, thereby decreasing undesired losses of aggregate. In exemplary aspects, where two or more lift gates 158 and slides 152 are used, each lift gate 158 and slide can be positioned in communication with a respective trough.

In an aspect, each trough of the aggregate distribution assembly 146 can include means for evenly distributing the aggregate within each trough 160. For example, in one aspect, the aggregate distribution assembly 146 can include at least one rotating auger 164 that is powered by a motor or other conventional means, which can optionally be communicatively coupled to the system controller 190 to permit selective control of the operation of each auger. In this aspect, an auger 164 can be positioned within each trough 160 of the aggregate distribution assembly. As the auger 164 rotates within the trough 160, the aggregate is evenly distributed within the trough 160 such that the aggregate reaches the extreme edges of the trough. Each trough 160 can define a plurality of apertures 161 within a bottom portion of the trough 160 to receive the distributed aggregate from the rotating augers 164. Optionally, the trough 160 can define interior surfaces that are inwardly sloped to funnel aggregate material from the rotating augers to the apertures 161. As the aggregate exits the trough through the apertures 161, the aggregate can fall substantially evenly on the dispensing roller 166. It is contemplated that the size of the apertures 161 at the bottom of the trough 160 can be selectively modified to adjust the rate of flow of material to the rollers. It is further contemplated that the even distribution of material within the trough 160 can ensure that the material is provided evenly to the roller.

Structurally, the roller(s) 166 can be positioned approximately below the apertures defined in the bottom of each trough 160. Thus, in some aspects, each roller 166 can be axially aligned with the trough and the apertures of the trough. In alternate embodiments, the roller 166 can be offset at a selected angle so long as the roller is able to sufficiently engage aggregate dispensed through the apertures of the troughs 160.

Each roller 166 can be oriented to rotate along an axis substantially parallel to the axis of rotation of the auger 164 (and substantially perpendicular to the axis of the truck). As the roller 166 rotates, the aggregate distributed from the mixing chamber can be received on a top surface of the roller 166 and then dispensed on to the pavement. It is contemplated that the aggregate can be substantially evenly distributed on the roadway surface in a controlled manner. It is contemplated that the rate of rotation of each roller 166 can be selectively controlled to maintain desired precision and control in the amount of aggregate that is delivered to the roadway surface, as well as the profile formed by the aggregate delivered to the roadway surface. In exemplary aspects, it is contemplated that each roller 166 can be configured to rotate in the direction of the movement of the vehicle. However, in other aspects, it is contemplated that each roller 166 can be configured to rotate in a direction opposite to the direction of movement of the vehicle.

In general, there can be a single roller 166 associated with a single trough 160. However, alternative arrangements are possible where the ratio of rollers 166 to troughs is greater than 1:1. For example, where more than one trough (e.g., two troughs) is provided, at least one roller (either a single roller or a plurality of rollers) can be associated with each respective trough. Similarly, it is contemplated that a single roller can be provided for a plurality of troughs. In exemplary aspects, it is contemplated that each roller can be secured to a portion of an associated trough 160.

In an alternative embodiment, at least one trough may be oriented to extend beyond the width of the truck. In exemplary aspects, the system can comprise means for automatically extending or retracting a trough relative to the transverse axis 12 to thereby control the operative width of the trough (and the width of the aggregate delivered to the roadway). Optionally, the means for automatically extending or retracting the trough 160 can comprise one or more conventional linear actuators, such as, for example and without limitation, hydraulic actuators. In an example employing multiple troughs, the troughs may be staggered relative to the transverse axis to permit coverage of a larger area of the roadway and/or to alter the potential distribution pattern of the aggregate. In further exemplary aspects, it is contemplated that the troughs can be staggered relative to the movement direction 10 of the vehicle, thereby reducing the width occupied by the troughs when they are in the stowed position.

In exemplary aspects, the dispensing roller(s) 166 can span the width of the rear end of the truck. Similar to the trough, the roller can be configured to extend beyond the width dimensions of the truck (or other vehicle) to provide more coverage of the roadway with the aggregate.

Figure 14B:
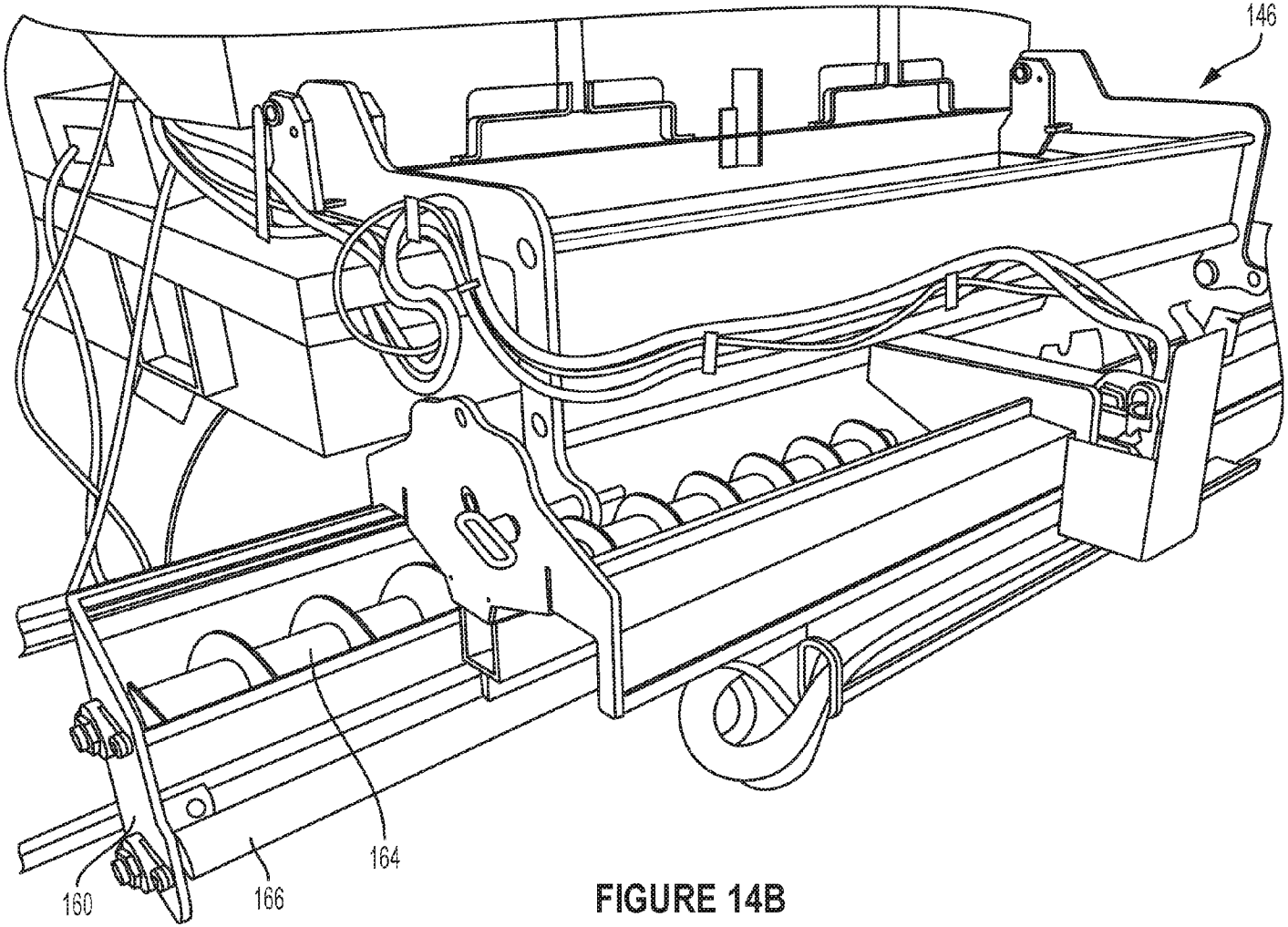
As shown in FIG. 14B, aggregate material can be selectively delivered from a hopper on the truck to two smaller hoppers of the aggregate distribution assembly, with each of the two smaller hoppers of the aggregate distribution assembly comprising an auger element that rotates to deliver aggregate material to a roller that rotates at a selected speed and in a selected direction to deliver the aggregate material to the roadway surface.

In yet another aspect, the aggregate distribution assembly can be configured for movement about and between a stowed/retracted position (FIGS. 11A-13) and a use/extended position (FIGS. 12A-12E and 14A-14B). For example, as shown in FIGS. 14A-14B, when in use the distribution apparatus can be positioned to the rear of the spraying element 104. Further, when the aggregate distribution assembly 146 is not in use, it can be retracted to the stowed position as shown in FIG. 13. As shown, in the stowed/retracted position, the distribution apparatus 146 can be further elevated from the pavement and retracted closer to the truck. In a further aspect, the retracted aggregate distribution assembly 146 can be retracted such that its resting position is above the spraying apparatus. In this example, the aggregate distribution assembly can be activated by extending and lowering it beyond the spraying apparatus 104. It is contemplated that the aggregate distribution assembly 146 can be selectively moved from the stowed/retracted position to the use/extended position using either manual or automated means. Optionally, in exemplary aspects, it is contemplated that the aggregate distribution assembly can comprise at least one actuator 147 (e.g., a linear or rotation actuator) for effecting movement of the aggregate distribution assembly about and between the stowed position and the use position. In these aspects, it is contemplated that the at least one actuator 147 can be communicatively coupled to the system controller 190 to permit selective control of the at least one actuator. In exemplary aspects, it is contemplated that in the stowed position, the aggregate distribution assembly can be located generally over a bed of the vehicle, while in the use position, the aggregate distribution assembly can be selectively rotated about at least one pin or other rotational/pivot point such that the troughs, augers, and rollers of the distribution assembly are positioned to the rear of the bed of the vehicle in an operative position closer to the road surface. It is contemplated that the axis of rotation of the distribution assembly can be aligned with or generally aligned with the transverse axis 12.

In yet another aspect, the aggregate distribution assembly 146 can be configured to be selectively removable from the truck when use of the apparatus is not required for a given project.

Figure 3B:
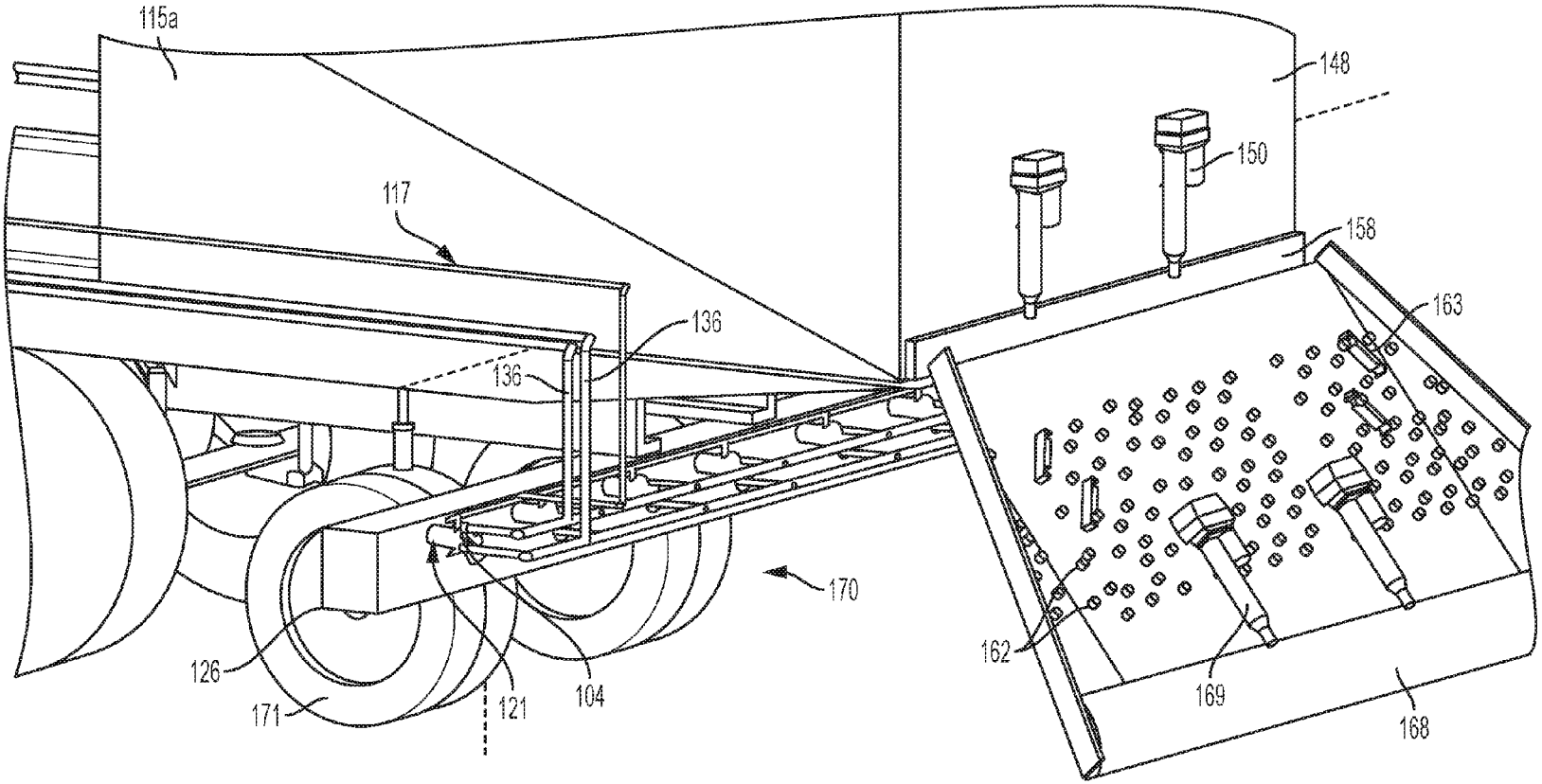
Figure 3C:
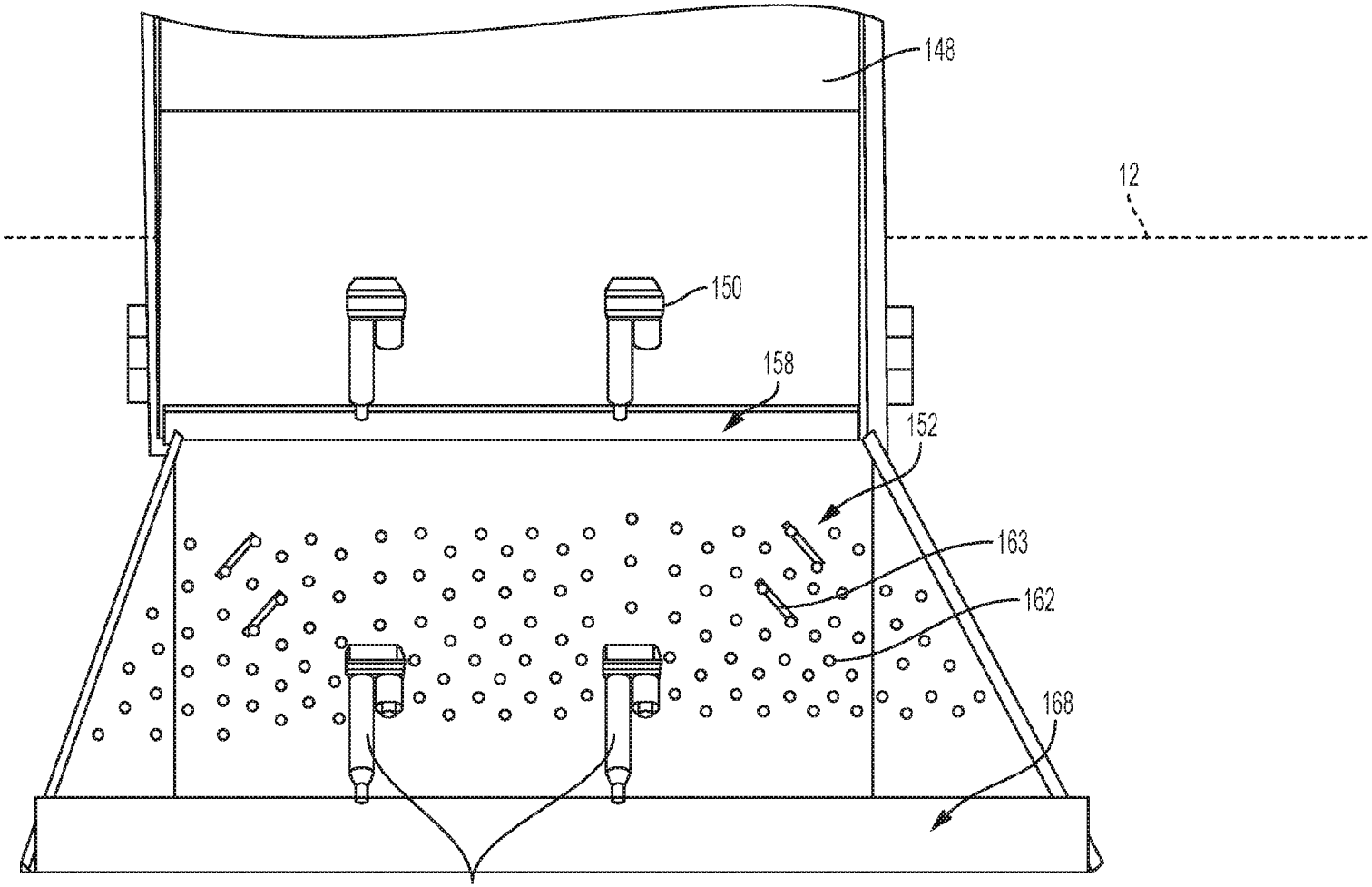
Figure 4A:
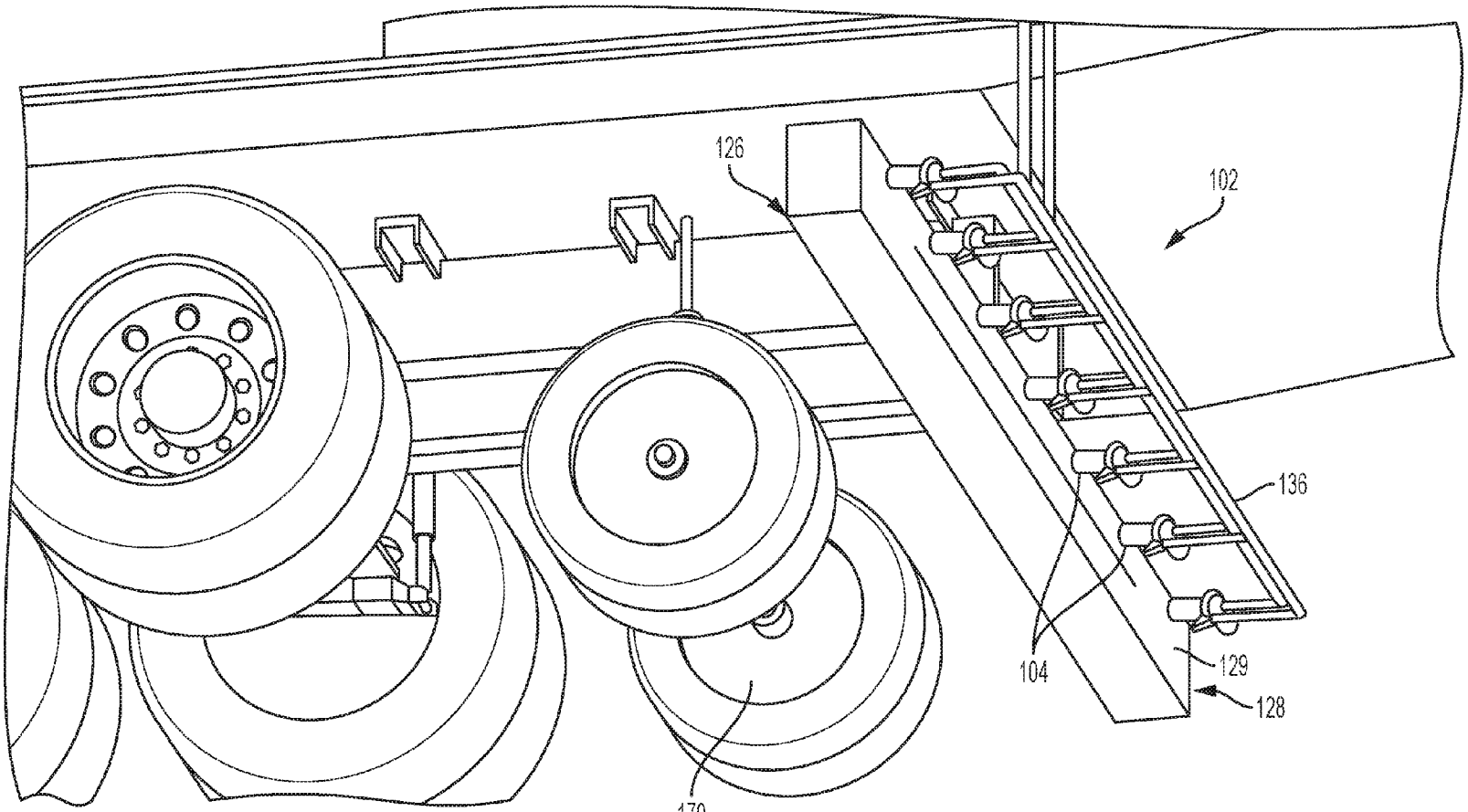
FIGS. 4A-4B are bottom perspective views that depict portions of an exemplary hydraulic traction drive assembly and an exemplary spray assembly as disclosed herein.
Figure 4B:
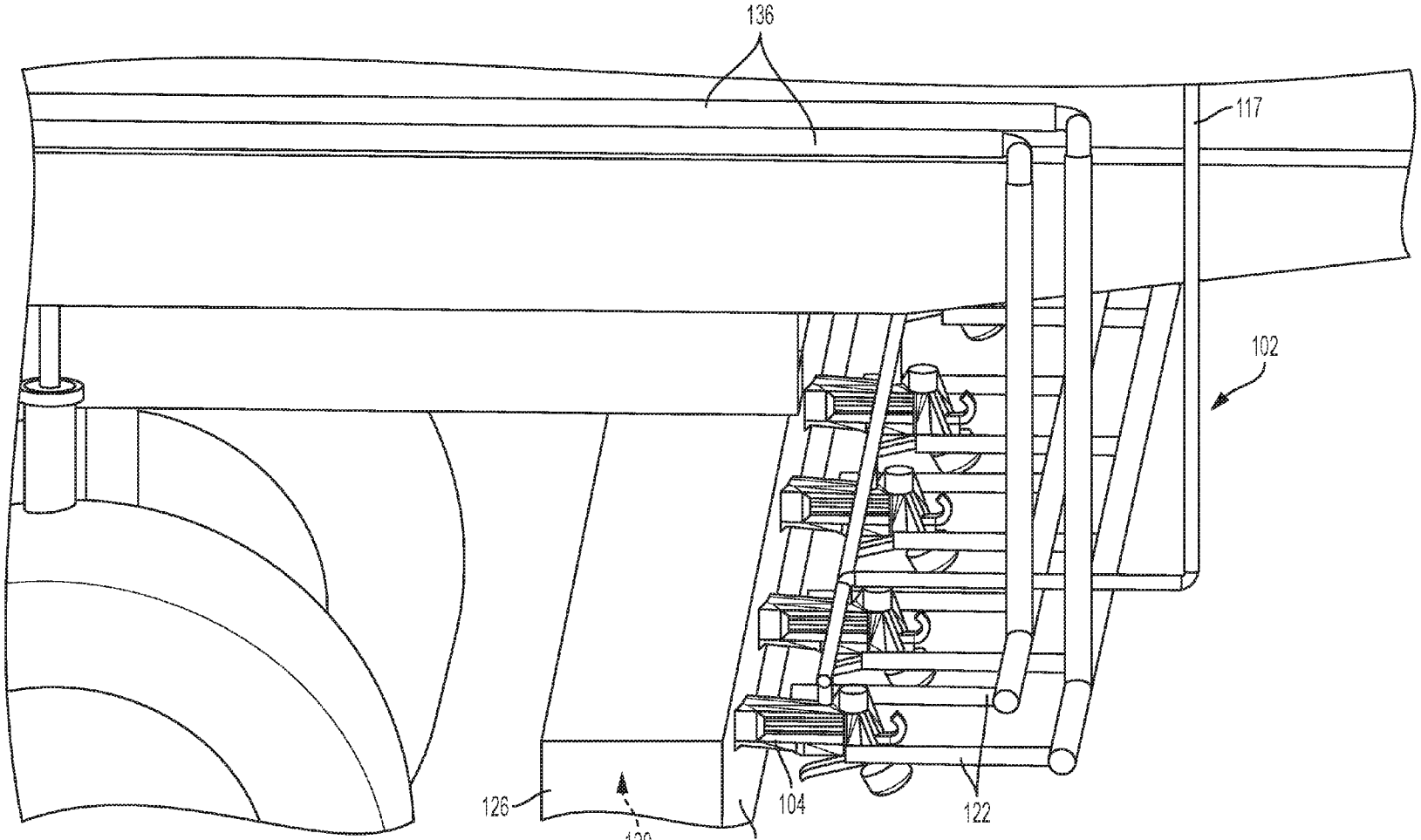
Figure 5A:
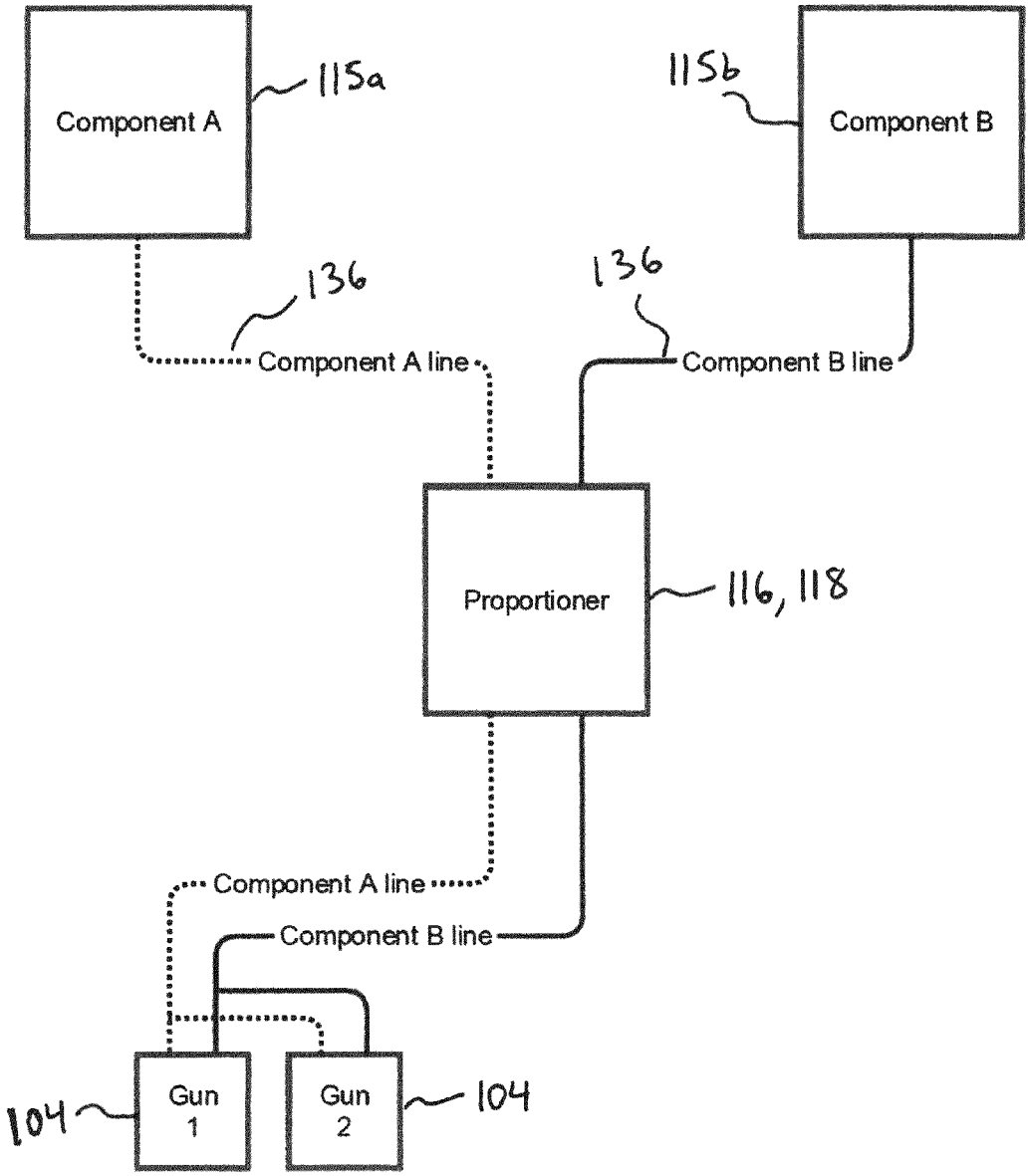
FIGS. 5A-5B are schematic diagrams depicting the flow of first and second resin or epoxy materials to a spray assembly as disclosed herein.
Figure 5B:
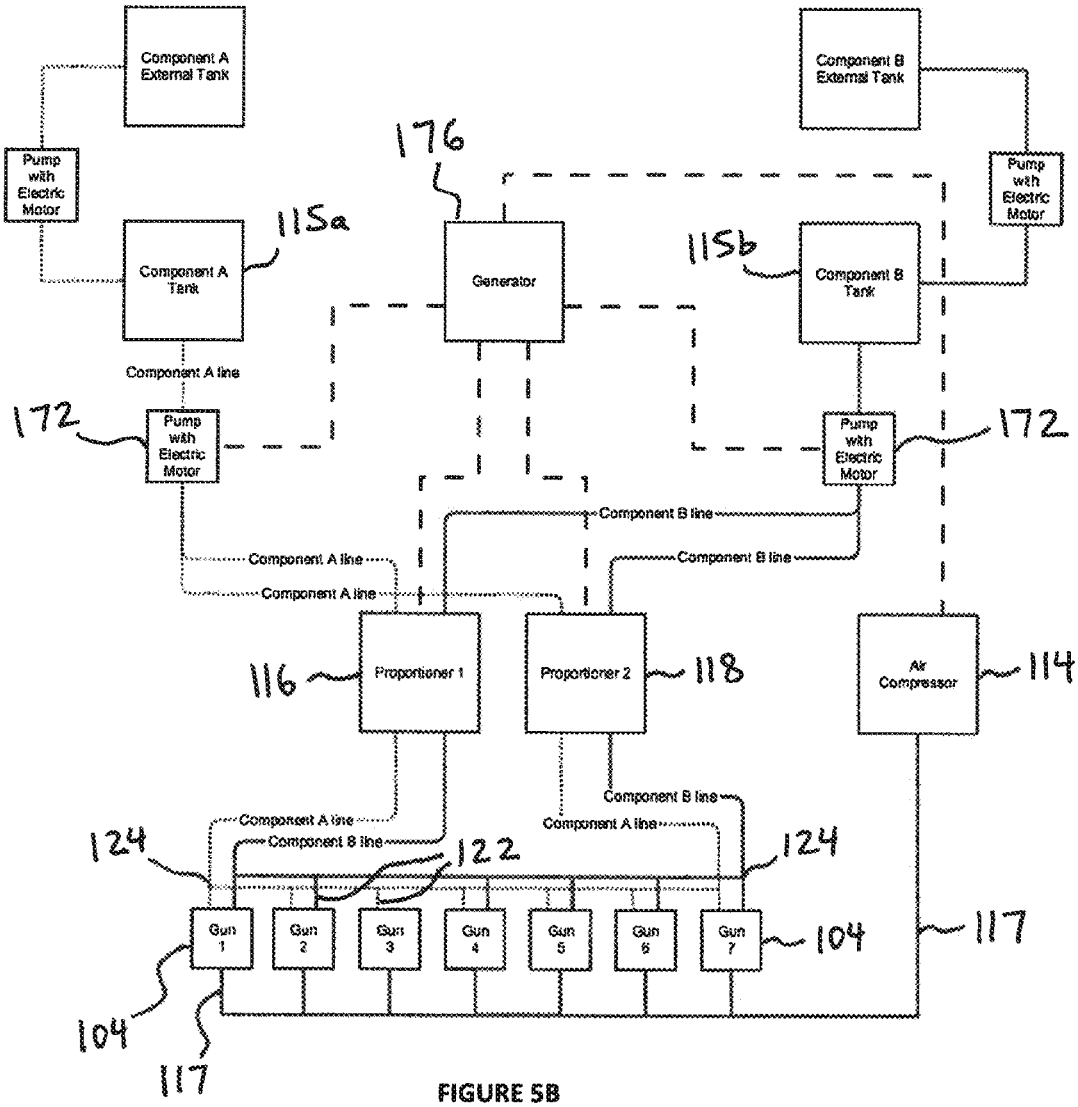
Figure 6:
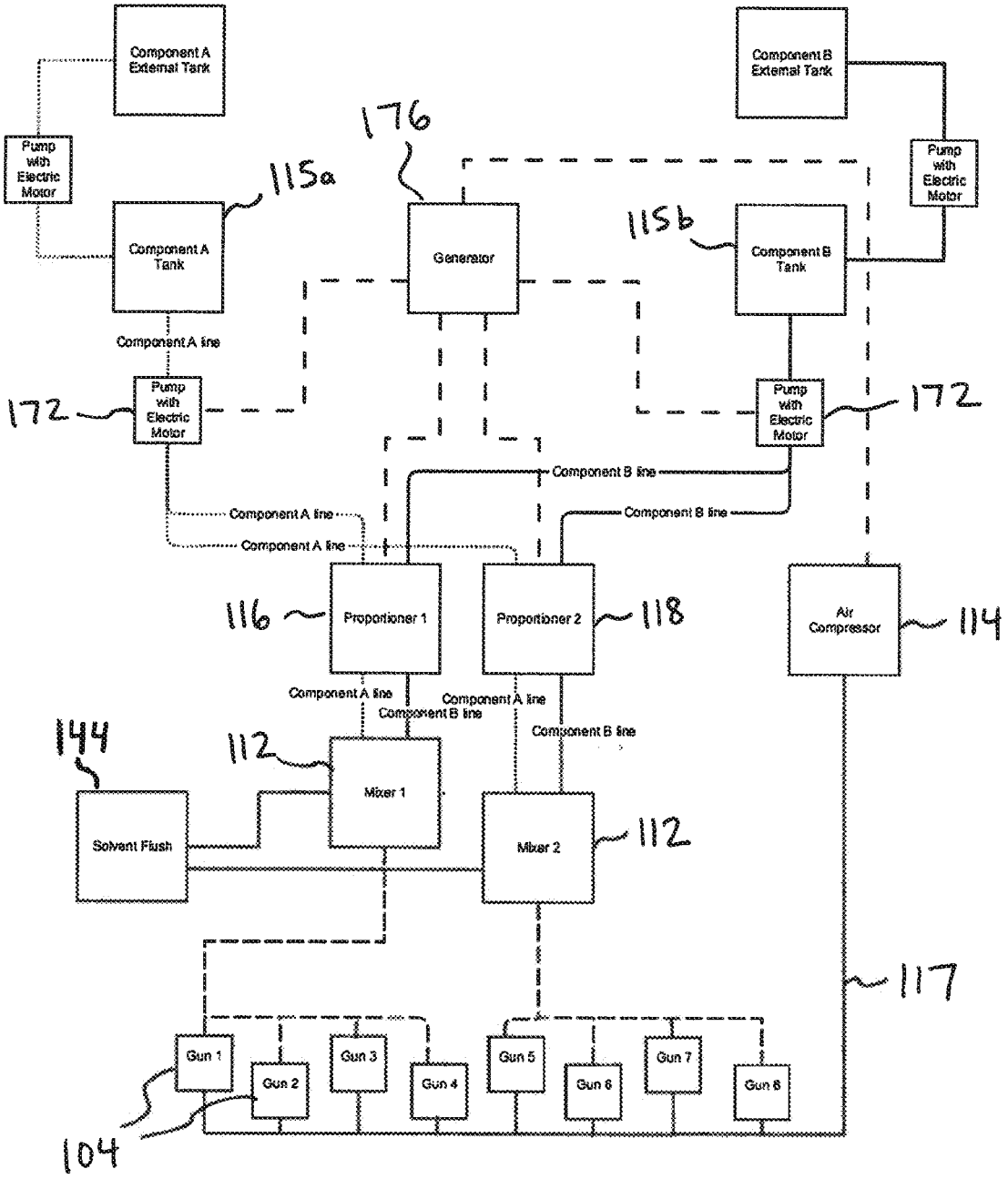
FIG. 6 is a schematic diagram depicting the flow of first and second resin or epoxy materials to a spray assembly as disclosed herein. Unlike the schematic diagram depicted in FIG. 5B, the schematic diagram of FIG. 6 discloses a solvent flush mechanism, static mixers, and a staggered arrangement of the spraying elements. Although spray guns are depicted in FIG. 6, it is contemplated that a similar arrangement can be used for other spraying elements (e.g., nozzles).

As shown in FIGS. 3A-3C, rather than comprising a trough 160 and dispensing roller 166, it is contemplated that the aggregate distribution assembly 146 can comprise a slide gate 168 that is positioned at a bottom/distal portion of the slide to control the rate at which aggregate exits the slide. Thus, instead of mixing the aggregate using the trough 160 and directing aggregate to the roadway using the rollers 166, the aggregate can be provided directly to the roadway from the aggregate slide 152. In these aspects, it is contemplated that the aggregate slide 152 can contain a collection of dowel 162 and removable channeling 163 (e.g., temporary dividers that selectively positionable over two or more dowels to direct the flow of aggregate) to divert some aggregate to the edges of the slide and maintain an overall even distribution of aggregate to the slide gate 168. The slide gate 168 can then control the aggregate flow into the resin that has been applied to the roadway surface. In exemplary aspects, it is contemplated that the slide gate 168 can be selectively moveable between a closed position that prevents aggregate from exiting the aggregate slide and an open position that permits dispersal of aggregate from the aggregate slide. Optionally, in these aspects, the slide gate 168 can be operatively coupled to an actuator 169 (e.g., a linear actuator) as is known in the art that can be selectively activated (optionally, by the system controller 190) to effect movement of the gate 168 about and between the closed position and the open position. In exemplary aspects, the slide gate 168 can be pivotally coupled to the slide such that the angle between the slide gate 168 and the slide is selectively adjustable to thereby control the rate at which material exits the slide. In other exemplary aspects, it is contemplated that the slide gate 168 can be selectively raised or lowered relative to an upper surface of the slide to control the dimensions of an opening between the slide gate and the slide to thereby control the rate at which material exits the slide.

In exemplary non-limiting aspects, the rear aggregate hopper (optionally, 8 feet wide) 148 can hold approximately 4×4,000 lbs. of aggregate bags preloaded before arrival on a job site. When the application of the epoxy resin begins, the hopper gate 158 can open with electric actuators 150 to distribute aggregate down the angled slide (optionally, angled at about 55 degrees). In use, the trough 160 and rollers (when present) or the dowels and channels of the aggregate gate (when the troughs and rollers are not present) can distribute the aggregate evenly to a desired width (typically 12-14 feet wide).

The front of the truck can have a removable hopper 154 (a front aggregate hopper) with a conveyor belt 156 to convey aggregate to the rear aggregate hopper 148 to allow continuous operation of the truck without stopping to refill the rear aggregate hopper.

Figure 15:
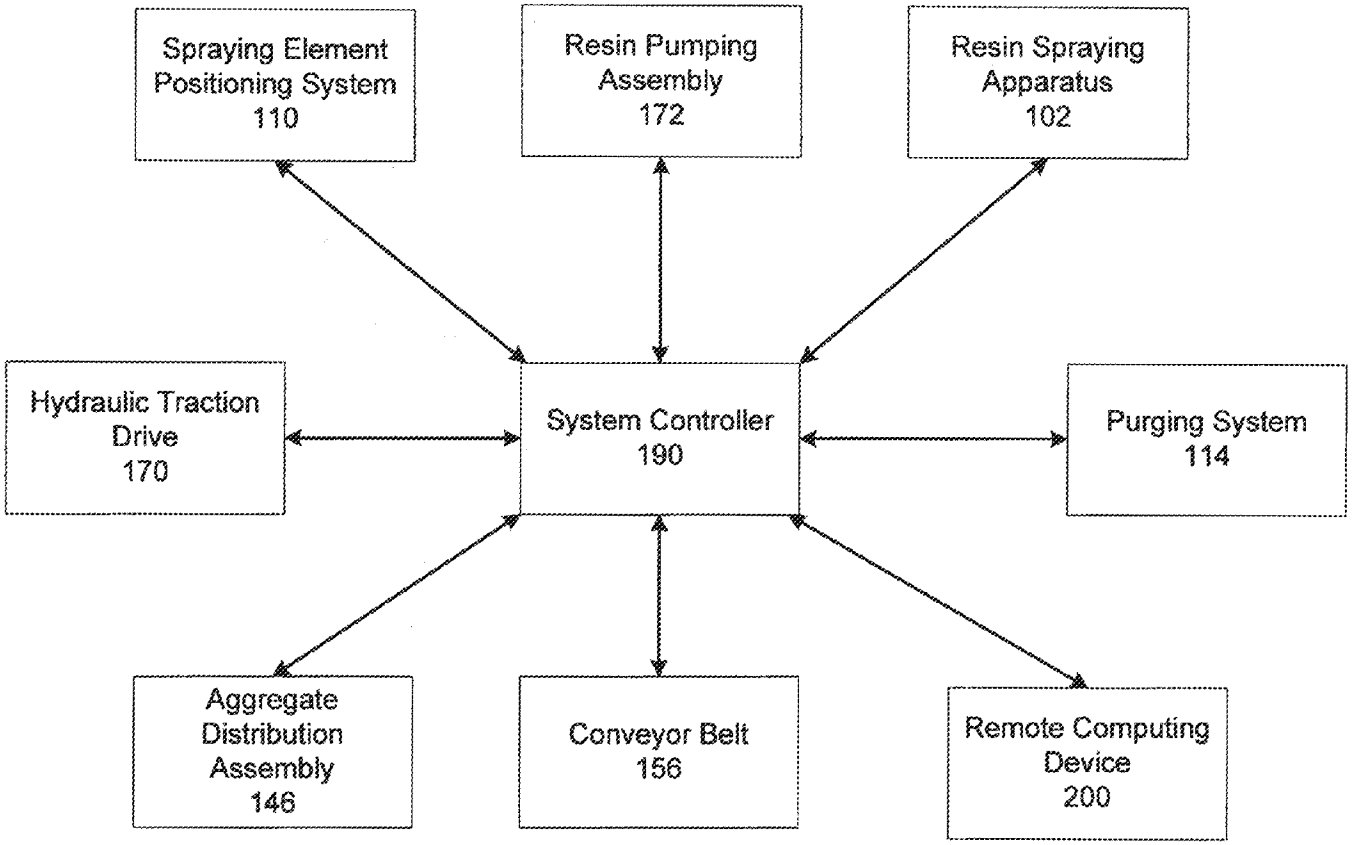
FIG. 15 is a schematic diagram depicting exemplary communication configurations between a system controller and various elements of disclosed systems for applying a roadway surface treatment.

In exemplary aspects, and with reference to FIG. 15, the disclosed systems can comprise a system controller 190 as further disclosed herein. In these aspects, and as further disclosed herein, it is contemplated that the system controller 190 can be communicatively coupled to various components of the system for purposes of controlling the operation of those components and/or receiving feedback from those components regarding the performance of the system. For example and without limitation, it is contemplated that the system controller can be communicatively coupled to one or more components of the hydraulic traction drive assembly 170, the resin pumping assembly 172, the resin spraying apparatus 102 (e.g., the actuators, pumps, sensors, valves, and/or flow control mechanisms), the purging system 114, the pressure sensors throughout the system, the conveyor belt 156, the spraying element positioning system 110, and/or the aggregate distribution assembly (e.g., the actuators, conveyor belts, augers, and/or rollers). In exemplary aspects, the system controller can comprise a processor and a memory in communication with the processor. In these aspects, it is contemplated that the processor can be configured to receive feedback from various components of the system. Optionally, it is contemplated that the system controller can be provided as a microcontroller, a programmable logic controller, or a component of computing device (e.g., a smartphone, a tablet, or a computer). However, it is contemplated that any processing element can be used. It is further contemplated that the processor can be configured to receive instructions from a remote location. Optionally, it is contemplated that the system 100 can further comprise at least one remote computing device 200 (e.g., a smartphone, a tablet, a computer, and the like) that is communicatively coupled to the system controller and configured to provide instructions to the system controller (and, optionally, to receive an output from the system controller). In use, the system controller can be configured to selectively modify the performance of the system components based upon feedback received from the system components and/or based upon instructions received from a remote location (e.g., a remote computing device 200). Optionally, in exemplary aspects, it is contemplated that the system controller can comprise a wireless receiver and a wireless transmitter (or combined wireless receiver/transmitter) as are known in the art. In these aspects, the system controller can be configured for wireless communication with components of the system that are provided with complementary wireless receiving and/or transmission capabilities. It is further contemplated that the system controller can be configured for wireless communication with users positioned at a remote location (e.g., workers monitoring the performance of the system from a roadside location or from within the truck). In exemplary aspects, it is contemplated that the system controller can be configured to wirelessly receive signals transmitted over an Internet, cellular, radiofrequency, or other conventional wireless transmission medium.

In further exemplary aspects, and with reference to FIGS. 1A, 2B, 5A, and 6, it is contemplated that the system 100 can comprise a generator 176 that is configured to power various components of the system. It is contemplated that any conventional generator 176 can be used. For example, it is contemplated that the generator 176 can be an electric generator or a gas generator as is known in the art. Optionally, the generator 176 can be positioned in electrical communication with the battery of the vehicle 180. Optionally, in exemplary aspects, the generator 176 can be communicatively coupled to the system controller 190 to permit selective control of the supply of power to the various system components.

In exemplary high-friction surface treatment applications, a single layer of mixed epoxy (optionally, 1:1 ratio 100% solids epoxy) at approximately 60 mil thickness is applied, and calcined bauxite is then applied to refusal. This process improves the friction quality of the road, making it safer, especially in asphalt and concrete curves, ramps, and intersections, which are the typical application areas.

Exemplary bridge deck overlay applications can follow a process similar to that of the high-friction surface treatment applications, although in such bridge deck overlay applications, the resin (e.g., epoxy resin) layer can have a different thickness, multiple lifts can be used, and flint stone can be used in place of calcined bauxite to promote bridge preservation.

In use, it is contemplated that the systems and methods disclosed herein can provide high pressure impingement mixing or static mixing in a fully-automated manner. It is further contemplated that the disclosed systems and methods can provide real-time width variation through shutoff of individual spraying elements 104, adjustment to the height of spraying elements, and/or adjustment of the aggregate distribution assembly, all of which can be adjusted during application. It is still further contemplated that the disclosed systems and methods can provide for quicker startup and shutdown in comparison to conventional roadway surface treatment application systems and methods. It is still further contemplated that the hydraulic traction drive assembly of the disclosed systems and methods can provide better control at application speeds than creep drives or other conventional methods. It is still further contemplated that the disclosed systems and methods can provide continuous aggregate (front hopper 154) and resin loading (extra Part A & B pumps) to thereby avoid transverse joints in roadways.

EXEMPLARY ASPECTS

In view of the described systems and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1

A system for applying a roadway surface treatment, the system being configured for coupling to a vehicle moving over a roadway surface in a selected travel direction and comprising: at least one container configured to receive at least one resin or epoxy component; a spraying assembly positioned in fluid communication with the at least one container and configured to controllably dispense onto a roadway surface the at least one resin or epoxy component received from each container; a hopper configured to receive and selectively dispense an aggregate material; a conveyor belt assembly configured to selectively deliver the aggregate material to the hopper, wherein the hopper comprises a gate that is selectively moveable from a closed position to an open position to dispense the aggregate onto the roadway surface at an aggregate delivery location, wherein the spraying assembly and the hopper are configured to continuously dispense the at least one resin or epoxy component and the aggregate material, and wherein the spraying assembly is spaced from the aggregate delivery location in the selected travel direction such that the hopper dispenses the aggregate material onto portions of the roadway surface that have been coated with the at least one resin or epoxy component dispensed by the spraying assembly.

Aspect 2

The system of aspect 1, wherein the spraying assembly comprises a plurality of spray elements.

Aspect 3

The system of aspect 2, wherein the plurality of spray elements comprises a plurality of spray nozzles.

Aspect 4

The system of aspect 3, wherein each spray nozzle of the plurality of spray nozzles comprises a check valve to permit backflow of the at least one resin or epoxy component.

Aspect 5

The system of aspect 4, wherein the spraying assembly further comprises a manifold that receives the at least one resin or epoxy component from the at least one container, wherein the manifold defines a plurality of outlet openings, and wherein each spray nozzle of the plurality of spray nozzles is positioned in fluid communication with a respective outlet opening of the manifold.

Aspect 6

The system of any one of aspects 3-5, wherein each spray nozzle comprises a spray tip, wherein the spray tips of the plurality of spray nozzles are staggered relative to the selected travel direction.

Aspect 7

The system of any one of the preceding aspects, further comprising: at least one trough configured to receive aggregate from the hopper, wherein each trough of the at least one trough has a longitudinal axis and a bottom surface that defines a plurality of apertures; at least one dispensing roller positioned beneath the plurality of apertures of the at least one trough, wherein each dispensing roller is configured to contact aggregate material as the aggregate material exits the plurality of apertures of a corresponding trough, wherein each dispensing roller is configured for rotation relative to a rotational axis that is substantially parallel to the longitudinal axis of a corresponding trough, and wherein rotation of each dispensing roller is configured to evenly dispense the aggregate material onto the roadway surface.

Aspect 8

The system of aspect 7, wherein the longitudinal axis of each trough and the rotational axis of each dispensing roller are substantially perpendicular to the selected travel direction.

Aspect 9

The system of aspect 7 or aspect 8, further comprising at least one auger assembly, wherein each auger assembly is positioned within a respective trough, and wherein the auger assembly within each trough is configured for rotation relative to the longitudinal axis of the trough to evenly disperse aggregate throughout the trough.

Aspect 10

The system of any one of aspects 7-9, further comprising at least one aggregate slide that extends downwardly from the hopper to the at least one trough, wherein the at least one aggregate slide is configured to receive aggregate from the hopper.

Aspect 11

The system of aspect 9 or aspect 10, wherein the at least one trough comprises a plurality of troughs, and wherein the at least one auger assembly comprises a plurality of auger assemblies.

Aspect 12

The system of aspect 11, wherein the plurality of troughs are staggered relative to a transverse axis that is perpendicular to a vertical axis and the selected travel direction, wherein the plurality of troughs are moveable about and between a retracted position and an extended position, wherein in the retracted position, the plurality of troughs cooperate to define a first aggregate distribution width, and wherein in the extended position, at least one trough of the plurality of troughs is translated relative to the transverse axis to define a second aggregate distribution width that is greater than the first aggregate distribution width.

Aspect 13

A system for applying a roadway surface treatment, the system comprising: a vehicle configured for movement over a roadway surface in a selected travel direction; a surface treatment application subsystem coupled to the vehicle and comprising: at least one container configured to receive at least one resin or epoxy component; a spraying assembly positioned in fluid communication with the at least one container and configured to controllably dispense onto a roadway surface the at least one resin or epoxy component received from each container; an aggregate distribution assembly having a hopper configured to receive and selectively dispense an aggregate material; a conveyor belt assembly configured to selectively deliver the aggregate material to the hopper of the aggregate distribution assembly, wherein the hopper comprises a gate that is selectively moveable from a closed position to an open position to dispense the aggregate onto the roadway surface at an aggregate delivery location, wherein the spraying assembly and the hopper are configured to continuously dispense the at least one resin or epoxy component and the aggregate material, and wherein the spraying assembly is spaced from the aggregate delivery location in the selected travel direction such that the hopper is configured to dispense the aggregate material onto portions of the roadway surface that have been coated with the at least one resin or epoxy component dispensed by the spraying assembly.

Aspect 14

The system of aspect 13, wherein the vehicle is a truck, and wherein the truck has a hydraulic traction drive assembly that is selectively engageable with the roadway surface to control the speed of the vehicle in the selected travel direction between 0 and 1 mile per hour.

Aspect 15

The system of aspect 12 or aspect 13, wherein the spraying assembly comprises a plurality of spray nozzles.

Aspect 16

The system of aspect 15, wherein each spray nozzle comprises a spray tip, wherein the spray tips of the plurality of spray nozzles are staggered relative to the selected travel direction.

Aspect 17

The system of any one of aspects 13-16, wherein the aggregate distribution assembly further comprises: at least one trough configured to receive aggregate from the hopper, wherein each trough of the at least one trough has a longitudinal axis and a bottom surface that defines a plurality of apertures; at least one dispensing roller positioned beneath the plurality of apertures of the at least one trough, wherein each dispensing roller is configured to contact aggregate material as the aggregate material exits the plurality of apertures of a corresponding trough, wherein each dispensing roller is configured for rotation relative to a rotational axis that is substantially parallel to the longitudinal axis of a corresponding trough, and wherein rotation of each dispensing roller is configured to evenly dispense the aggregate material onto the roadway surface.

Aspect 18

The system of aspect 17, further comprising at least one auger assembly, wherein each auger assembly is positioned within a respective trough, and wherein the auger assembly within each trough is configured for rotation relative to the longitudinal axis of the trough to evenly disperse aggregate throughout the trough.

Aspect 19

The system of aspect 18, wherein the at least one trough comprises a plurality of troughs, wherein the at least one auger assembly comprises a plurality of auger assemblies, wherein the plurality of troughs are staggered relative to a transverse axis that is perpendicular to a vertical axis and the selected travel direction, wherein the plurality of troughs are moveable about and between a retracted position and an extended position, wherein in the retracted position, the plurality of troughs cooperate to define a first aggregate distribution width, and wherein in the extended position, at least one trough of the plurality of troughs is translated relative to the transverse axis to define a second aggregate distribution width that is greater than the first aggregate distribution width.

Aspect 20

A method of applying a surface treatment to a roadway, comprising: coupling a surface treatment application subsystem to a vehicle, the surface treatment application subsystem comprising: at least one container configured to receive at least one resin or epoxy component; a spraying assembly positioned in fluid communication with the at least one container and configured to controllably dispense onto a roadway surface the at least one resin or epoxy component received from each container; an aggregate distribution assembly having a hopper configured to receive and selectively dispense an aggregate material; a conveyor belt assembly configured to selectively deliver the aggregate material to the hopper of the aggregate distribution assembly, wherein the hopper comprises a gate that is selectively moveable from a closed position to an open position to dispense the aggregate onto the roadway surface at an aggregate delivery location; moving the vehicle over the roadway surface in a selected travel direction; during movement of the vehicle in the selected travel direction, using the spraying assembly and the hopper to continuously dispense the at least one resin or epoxy component and the aggregate material onto the roadway surface, wherein the spraying assembly is spaced from the aggregate delivery location in the selected travel direction such that the hopper dispenses the aggregate material onto portions of the roadway surface that have been coated with the at least one resin or epoxy component dispensed by the spraying assembly.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference.

Although the foregoing invention has been described in some detail by way of illustration and example for purposes of clarity of understanding, certain changes and modifications may be practiced within the scope of the appended claims.

What is claimed is:

1. A system for applying a roadway surface treatment, the system being configured for coupling to a vehicle moving over a roadway surface in a selected travel direction, the system having a longitudinal axis parallel to the selected travel direction and comprising:

at least one container configured to receive at least one resin or epoxy component;

a spraying assembly positioned in fluid communication with the at least one container and configured to controllably dispense onto a roadway surface the at least one resin or epoxy component received from each container, wherein the spraying assembly comprises a plurality of spray nozzles, each spray nozzle comprising a spray tip;

a hopper configured to receive and selectively dispense an aggregate material;

a conveyor belt assembly configured to selectively deliver the aggregate material to the hopper, wherein the hopper comprises a gate that is selectively moveable from a closed position to an open position to dispense the aggregate onto the roadway surface at an aggregate delivery location, wherein the spraying assembly and the hopper are configured to continuously dispense the at least one resin or epoxy component and the aggregate material, wherein the spraying assembly is spaced from the aggregate delivery location in the selected travel direction such that the hopper dispenses the aggregate material onto portions of the roadway surface that have been coated with the at least one resin or epoxy component dispensed by the spraying assembly, and wherein at least a portion of each spray nozzle of the plurality of spray nozzles is selectively axially moveable relative to the longitudinal axis of the system to adjust an axial position of the spray tip of the spray nozzle and to modify a distribution pattern of the at least one resin or epoxy component.

2. The system of claim 1, wherein the spraying assembly further comprises a manifold that receives the at least one resin or epoxy component from the at least one container, wherein the manifold defines a plurality of outlet openings, and wherein each spray nozzle of the plurality of spray nozzles is positioned in fluid communication with a respective outlet opening of the manifold.

3. The system of claim 1, wherein each spray nozzle comprises an extending member that is configured for selective axial advancement or retraction relative to the longitudinal axis of the system.

4. The system of claim 1, wherein a location of each spray nozzle of the plurality of spray nozzles relative to a transverse axis is selectively adjustable to modify the distribution pattern of the at least one resin or epoxy component, wherein the transverse axis is perpendicular to a vertical axis and the longitudinal axis of the system.

5. The system of claim 1, wherein at least one spray nozzle of the plurality of spray nozzles is positioned at a different height relative to a vertical axis than at least one other spray nozzle of the plurality of spray nozzles.

6. The system of claim 2, further comprising:

a mount assembly configured to extend along a rear of the vehicle, the mount assembly defining the manifold; and a frame that is coupled to the mount assembly and movably coupled to the vehicle, wherein movement of the frame effects a corresponding movement of the mount assembly and the plurality of spray nozzles.

7. The system of claim 1, wherein the spray tips of the plurality of spray nozzles are staggered relative to the longitudinal axis of the system.

8. The system of claim 1, further comprising:

at least one trough configured to receive aggregate from the hopper, wherein each trough of the at least one trough has a longitudinal axis and a bottom surface that defines a plurality of apertures;

at least one dispensing roller positioned beneath the plurality of apertures of the at least one trough, wherein each dispensing roller is configured to contact aggregate material as the aggregate material exits the plurality of apertures of a corresponding trough, wherein each dispensing roller is configured for rotation relative to a rotational axis that is substantially parallel to the longitudinal axis of a corresponding trough, and wherein rotation of each dispensing roller is configured to evenly dispense the aggregate material onto the roadway surface.

9. The system of claim 8, wherein the longitudinal axis of each trough and the rotational axis of each dispensing roller are substantially perpendicular to the selected travel direction.

10. The system of claim 8, further comprising at least one auger assembly, wherein each auger assembly is positioned within a respective trough, and wherein the auger assembly within each trough is configured for rotation relative to the longitudinal axis of the trough to evenly disperse aggregate throughout the trough.

11. The system of claim 10, further comprising at least one aggregate slide that extends downwardly from the hopper to the at least one trough, wherein the at least one aggregate slide is configured to receive aggregate from the hopper.

12. The system of claim 10, wherein the at least one trough comprises a plurality of troughs, and wherein the at least one auger assembly comprises a plurality of auger assemblies.

13. The system of claim 12, wherein the plurality of troughs are staggered relative to a transverse axis that is perpendicular to a vertical axis and the selected travel direction, wherein the plurality of troughs are moveable about and between a retracted position and an extended position, wherein in the retracted position, the plurality of troughs cooperate to define a first aggregate distribution width, and wherein in the extended position, at least one trough of the plurality of troughs is translated relative to the transverse axis to define a second aggregate distribution width that is greater than the first aggregate distribution width.

14. A system for applying a roadway surface treatment, the system comprising:

a vehicle configured for movement over a roadway surface in a selected travel direction;

a surface treatment application subsystem coupled to the vehicle, the surface treatment application subsystem having a longitudinal axis parallel to the selected travel direction and comprising:

at least one container configured to receive at least one resin or epoxy component;

a spraying assembly positioned in fluid communication with the at least one container and configured to controllably dispense onto a roadway surface the at least one resin or epoxy component received from each container, wherein the spraying assembly comprises a plurality of spray nozzles, each spray nozzle comprising a spray tip;

an aggregate distribution assembly having a hopper configured to receive and selectively dispense an aggregate material;

a conveyor belt assembly configured to selectively deliver the aggregate material to the hopper of the aggregate distribution assembly, wherein the hopper comprises a gate that is selectively moveable from a closed position to an open position to dispense the aggregate onto the roadway surface at an aggregate delivery location, wherein the spraying assembly and the hopper are configured to continuously dispense the at least one resin or epoxy component and the aggregate material, wherein the spraying assembly is spaced from the aggregate delivery location in the selected travel direction such that the hopper is configured to dispense the aggregate material onto portions of the roadway surface that have been coated with the at least one resin or epoxy component dispensed by the spraying assembly, and wherein at least a portion of each spray nozzle of the plurality of spray nozzles is selectively axially moveable relative to the longitudinal axis of the surface treatment application subsystem to adjust an axial position of the spray tip of the spray nozzle and to modify a distribution pattern of the at least one resin or epoxy component.

15. The system of claim 14, wherein the vehicle is a truck, and wherein the truck has a hydraulic traction drive assembly that is selectively engageable with the roadway surface to control the speed of the vehicle in the selected travel direction between 0 and 1 mile per hour.

16. The system of claim 14, wherein the spray tips of the plurality of spray nozzles are staggered relative to the longitudinal axis of the surface treatment application subsystem.

17. The system of claim 14, wherein the aggregate distribution assembly further comprises:

at least one trough configured to receive aggregate from the hopper, wherein each trough of the at least one trough has a longitudinal axis and a bottom surface that defines a plurality of apertures;

at least one dispensing roller positioned beneath the plurality of apertures of the at least one trough, wherein each dispensing roller is configured to contact aggregate material as the aggregate material exits the plurality of apertures of a corresponding trough, wherein each dispensing roller is configured for rotation relative to a rotational axis that is substantially parallel to the longitudinal axis of a corresponding trough, and wherein rotation of each dispensing roller is configured to evenly dispense the aggregate material onto the roadway surface.

18. The system of claim 17, further comprising at least one auger assembly, wherein each auger assembly is positioned within a respective trough, and wherein the auger assembly within each trough is configured for rotation relative to the longitudinal axis of the trough to evenly disperse aggregate throughout the trough.

19. The system of claim 18, wherein the at least one trough comprises a plurality of troughs, wherein the at least one auger assembly comprises a plurality of auger assemblies, wherein the plurality of troughs are staggered relative to a transverse axis that is perpendicular to a vertical axis and the selected travel direction, wherein the plurality of troughs are moveable about and between a retracted position and an extended position, wherein in the retracted position, the plurality of troughs cooperate to define a first aggregate distribution width, and wherein in the extended position, at least one trough of the plurality of troughs is translated relative to the transverse axis to define a second aggregate distribution width that is greater than the first aggregate distribution width.

20. A method of applying a surface treatment to a roadway, comprising:

coupling a surface treatment application subsystem to a vehicle, the surface treatment application subsystem comprising:

at least one container configured to receive at least one resin or epoxy component;

a spraying assembly positioned in fluid communication with the at least one container and configured to controllably dispense onto a roadway surface the at least one resin or epoxy component received from each container, wherein the spraying assembly comprises a plurality of spray nozzles, each spray nozzle comprising a spray tip;

an aggregate distribution assembly having a hopper configured to receive and selectively dispense an aggregate material;

a conveyor belt assembly configured to selectively deliver the aggregate material to the hopper of the aggregate distribution assembly, wherein the hopper comprises a gate that is selectively moveable from a closed position to an open position to dispense the aggregate onto the roadway surface at an aggregate delivery location;

selectively axially moving at least a portion of at least one spray nozzle of the plurality of spray nozzles relative to a longitudinal axis of the vehicle to adjust an axial location of the spray tip of the at least one spray nozzle and to modify a distribution pattern of the at least one resin or epoxy component;

moving the vehicle over the roadway surface in a selected travel direction that is parallel to the longitudinal axis of the vehicle;

during movement of the vehicle in the selected travel direction, using the spraying assembly and the hopper to continuously dispense the at least one resin or epoxy component and the aggregate material onto the roadway surface, wherein the spraying assembly is spaced from the aggregate delivery location in the selected travel direction such that the hopper dispenses the aggregate material onto portions of the roadway surface that have been coated with the at least one resin or epoxy component dispensed by the spraying assembly.

* * * * *